US012181214B2

(12) United States Patent
Thomas et al.

(10) Patent No.: US 12,181,214 B2
(45) Date of Patent: Dec. 31, 2024

(54) METHODS AND CONFIGURATIONS FOR LNG LIQUEFACTION

(71) Applicant: JTurbo Engineering & Technology, LLC, Sugar Land, TX (US)

(72) Inventors: Jacob Thomas, Sugar Land, TX (US); Nickey Jacob Thomas, Sugar Land, TX (US)

(73) Assignee: JTurbo Engineering & Technology, LLC, Sugar Land, TX (US)

( * ) Notice: Subject to any disclaimer, the term of this patent is extended or adjusted under 35 U.S.C. 154(b) by 58 days.

(21) Appl. No.: 17/452,249

(22) Filed: Oct. 26, 2021

(65) Prior Publication Data

US 2022/0128298 A1 Apr. 28, 2022

Related U.S. Application Data

(60) Provisional application No. 63/105,848, filed on Oct. 26, 2020.

(51) Int. Cl.
*F25J 1/02* (2006.01)
*F25J 1/00* (2006.01)

(52) U.S. Cl.
CPC ..... *F25J 1/0022* (2013.01); *F25J 1/0204* (2013.01); *F25J 1/0263* (2013.01); *F25J 1/0288* (2013.01);
(Continued)

(58) Field of Classification Search
CPC ..... F25J 1/0035; F25J 1/0022; F25J 1/0211; F25J 1/0212; F25J 2210/62; F25J 2240/02
See application file for complete search history.

(56) References Cited

U.S. PATENT DOCUMENTS 5,363,655 A 11/1994 Kikkawa et al.
5,755,114 A 5/1998 Foglietta
(Continued)

FOREIGN PATENT DOCUMENTS

KR 20050094798 A 9/2005
KR 102034477 B1 10/2019
WO WO-2016015855 A1 * 2/2016 ..... C01B 23/0036

OTHER PUBLICATIONS

International Search Report and Written Opinion dated Feb. 14, 2022 for corresponding PCT Application No. PCTUS2021056573 filed Oct. 26, 2021.

*Primary Examiner* — Brian M King
(74) *Attorney, Agent, or Firm* — K&L Gates LLP

(57) ABSTRACT

Systems and methods for pre-cooling a natural gas stream to a liquefaction plant. A system may include a compressor configured to receive a first natural gas stream at a first pressure and produce a second natural gas stream at a second pressure; an exchanger to cool the second natural gas stream; and an expander to receive the cooled natural gas stream and expand the cooled natural gas stream to produce a chilled natural gas stream.

The refrigeration content of the refrigerant is used to liquefy and sub-cool the natural gas stream to produce liquefied natural gas in a cold box or cryogenic exchanger. The refrigerant may be an external gas or an internal refrigerant working fluid expanded and compressed in a twin compander arrangement and compressed by a refrigerant compressor, or an external single mixed refrigerant working fluid compressed by a refrigerant compressor and expanded thru a JT valve.

20 Claims, 10 Drawing Sheets

(52) U.S. Cl.
CPC ..... *F25J 1/0294* (2013.01); *F25J 2210/06* (2013.01); *F25J 2210/62* (2013.01); *F25J 2240/02* (2013.01)

(56) References Cited

U.S. PATENT DOCUMENTS

| | | | | |
|---|---|---|---|---|
| 7,673,476 | B2 | 3/2010 | Whitesell | |
| 10,330,382 | B2 | 6/2019 | Mak et al. | |
| 10,605,522 | B2 | 3/2020 | Mak et al. | |
| 2014/0318178 | A1 | 10/2014 | Del Campo | |
| 2017/0038136 | A1* | 2/2017 | Turney | F25J 1/0022 |
| 2018/0003429 | A1 | 1/2018 | Mak | |
| 2018/0058753 | A1 | 3/2018 | Mak et al. | |
| 2018/0231303 | A1* | 8/2018 | Pierre, Jr. | F25J 1/0278 |
| 2019/0195536 | A1* | 6/2019 | Lee | F25J 1/0212 |
| 2021/0088274 | A1* | 3/2021 | Liu | F25J 1/0022 |

* cited by examiner

| LNG Liquefaction & Refrigeration Summary (Average Ambient Temperature $77^0$ F) | | | |
|---|---|---|---|
| Description | PSMR | PTEXP-N2 Cycle | PTEXP-CH4 Cycle |
| Treated Feed Gas (MMSCFD) | 134.50 | 134.50 | 134.50 |
| LNG (MMSCFD) | 134.50 | 134.50 | 133.40 |
| LNG Loading (TPD) | 3,051 | 3,022 | 3,014 |
| LNG Loading (MTA) | 1.114 | 1.103 | 1.100 |
| Specific Refrigerant Power (kW/Ton) | 256.51 | 269.00 | 283.50 |
| Total Refrigerant Power (kW) | 32,610 | 33,874 | 35,599 |
| Power Balance (%) | 1.000 | 1.049 | 1.105 |

Other LNG Liquefaction Technology

| | |
|---|---|
| APCI $C_3$MR Specific Refrigerant Power (kW/Ton) | 276 |
| APCI SMR Specific Refrigerant Power (kW/Ton) | 300 |
| Linde LIMUM SMR Specific Refrigerant Power (kW/Ton) | 324 |
| Other Gas (N2 & CH4) Expander Cycle Specific Refrigerant Power (kW/Ton) | 350-400 |
| COP Optimized Cascade: Specific Refrigerant Power (kW/Ton) | 340 |
| GE Oil and Gas PSMR: Specific Refrigerant Power (kW/Ton) | 300 |

Legend

PSMR: Pre-cooled Single Mixed Refrigerant Cycle
PTEXP-N2: Pre-cooled Twin Expander Nitrogen Cycle
PTEXP-CH4: Pre-cooled Twin Expander Methane Cycle

FIG. 4

Heat & Material Balance - Pre-Cooled Single Mixed Refrigerant (PSMR) Process

| Stream | Unit | 30 | 31 | 33 | 35 | 40 | 41 | 42 | 51 | 53 | 53A | 54A | 55 | 56 | 57 | 58 | 59 | 60 | 62 | 63 | 64 | 65 | 70 |
|---|---|---|---|---|---|---|---|---|---|---|---|---|---|---|---|---|---|---|---|---|---|---|---|
| | | | | | | | | | | | | | | | | | | | | | | | |
| Vapour Fraction | | 1.00 | 1.00 | 1.00 | 1.00 | 1.00 | 0.00 | 1.00 | 1.00 | 0.85 | 0.00 | 0.79 | 0.60 | 1.00 | 0.00 | 0.10 | 1.00 | 0.08 | 0.08 | 1.00 | 1.00 | 1.00 | 0.00 |
| Molecular Weight | | 16.52 | 16.61 | 16.61 | 16.62 | 16.62 | 16.62 | 16.62 | 34.29 | 34.29 | 58.40 | 30.15 | 34.29 | 27.03 | 45.13 | 34.29 | 34.29 | 16.62 | 16.62 | 17.25 | 17.25 | 17.25 | 16.52 |
| Temperature | F | 93.2 | 93.3 | 95.0 | 95.0 | -2.3 | -227.0 | -2.3 | 67.7 | 95.0 | 100.0 | 95.0 | 104.4 | 104.3 | 104.3 | -233.8 | 67.8 | -249.1 | -249.1 | -258.7 | -15.1 | 95.0 | -257.9 |
| Pressure | psia | 985.0 | 985.0 | 1540.8 | 2497.0 | 1100.0 | 1085.5 | 1100.0 | 48.0 | 245.6 | 800.0 | 792.7 | 792.7 | 791.3 | 791.3 | 56.3 | 49.0 | 25.0 | 25.0 | 15.0 | 15.5 | 995.0 | 150.0 |
| Molar Flow | lbmole/hr | 14,800 | 16,949 | 16,949 | 16,868 | 15,940 | 15,940 | 928 | 28,600 | 28,600 | 4,192 | 24,408 | 28,600 | 17,129 | 11,471 | 28,600 | 28,600 | 15,940 | 928 | 2,149 | 2,149 | 2,149 | 14,719 |
| Mass Flow | lb/hr | 244,523 | 281,589 | 281,589 | 280,270 | 264,855 | 264,855 | 15,415 | 980,658 | 980,658 | 244,844 | 735,813 | 980,658 | 462,997 | 517,661 | 980,658 | 980,658 | 264,855 | 15,415 | 37,058 | 37,058 | 37,066 | 242,212 |
| Heat Flow | Btu/hr | -4.82E+08 | -5.44E+08 | -5.48E+08 | -5.52E+08 | -5.31E+08 | -6.01E+08 | -3.09E+07 | -1.09E+09 | -1.12E+09 | -2.71E+08 | -8.88E+08 | -1.16E+09 | -5.51E+08 | -6.07E+08 | -1.98E+09 | -1.09E+09 | -6.02E+08 | -3.51E+07 | -6.81E+07 | -6.39E+07 | -6.28E+07 | -5.69E+08 |
| Vapor Phase | | | | | | | | | | | | | | | | | | | | | | | |
| Molar Flow | lbmole/hr | 14,800 | 16,949 | 16,949 | 16,868 | 15,940 | - | 928 | 28,600 | 24,408 | - | 19,341 | 17,119 | 17,129 | 0 | 2,749 | 28,600 | 1,336 | 75 | 2,419 | 2,149 | 2,149 | - |
| Mass Flow | lb/hr | 244,523 | 281,589 | 281,589 | 280,270 | 264,855 | - | 15,415 | 980,658 | 735,813 | - | 518,885 | 462,760 | 462,997 | 0 | 58,027 | 980,658 | 23,422 | 1,319 | 37,058 | 37,058 | 37,066 | - |
| Std Gas Flow | MMSCFD | 134.53 | 154.07 | 154.07 | 153.33 | 144.90 | - | 8.43 | 259.97 | 221.87 | - | 175.81 | 155.51 | 155.70 | 0.00 | 24.99 | 259.97 | 12.15 | 0.68 | 19.53 | 19.53 | 19.54 | - |
| Actual Gas Flow | ACFM | 1303.84 | 1498.64 | 916.52 | 547.36 | 871.04 | - | 50.70 | 54467.55 | 8812.74 | - | 1798.74 | 1659.82 | 1564.27 | 0.00 | 1862.30 | 53335.08 | 1919.72 | 107.90 | 4665.08 | 10979.44 | 192.81 | - |
| Molecular Weight | | 16.52 | 16.61 | 16.61 | 16.62 | 16.62 | - | 16.62 | 34.29 | 30.15 | - | 26.83 | 27.03 | 27.03 | 27.03 | 24.75 | 34.29 | 17.53 | 17.56 | 17.25 | 17.25 | 17.25 | - |
| Mass Density | lb/ft3 | 3.126 | 3.132 | 5.121 | 8.534 | 5.068 | - | 5.068 | 0.300 | 1.392 | - | 4.808 | 4.647 | 4.637 | 4.637 | 0.609 | 0.306 | 0.203 | 0.204 | 0.132 | 0.056 | 3.204 | - |
| Mass Heat Capacity | Btu/lb-F | 0.647 | 0.639 | 0.714 | 0.808 | 0.813 | - | 0.813 | 0.418 | 0.470 | - | 0.611 | 0.592 | 0.591 | 0.591 | 0.313 | 0.418 | 0.481 | 0.480 | 0.482 | 0.470 | 0.587 | - |
| Thermal Conductivity | Btu/hr-ft-F | 0.024 | 0.024 | 0.026 | 0.033 | 0.022 | - | 0.022 | 0.013 | 0.015 | - | 0.019 | 0.019 | 0.019 | 0.019 | 0.007 | 0.013 | 0.006 | 0.006 | 0.006 | 0.015 | 0.023 | - |
| Viscosity | cP | 0.013 | 0.013 | 0.015 | 0.018 | 0.013 | - | 0.013 | 0.010 | 0.012 | - | 0.014 | 0.014 | 0.014 | 0.014 | 0.007 | 0.010 | 0.005 | 0.005 | 0.005 | 0.010 | 0.014 | - |
| Cp/Cv | | 1.521 | 1.518 | 1.636 | 1.742 | 1.899 | - | 1.899 | 1.184 | 1.274 | - | 1.613 | 1.563 | 1.562 | 1.562 | 1.448 | 1.184 | 1.370 | 1.370 | 1.357 | 1.331 | 1.507 | - |
| Z Factor | | 0.878 | 0.881 | 0.840 | 0.817 | 0.735 | - | 0.735 | 0.959 | 0.894 | - | 0.743 | 0.752 | 0.752 | 0.752 | 0.943 | 0.959 | 0.954 | 0.954 | 0.967 | 0.996 | 0.900 | - |
| Liquid Phase | | | | | | | | | | | | | | | | | | | | | | | |
| Molar Flow | lbmole/hr | - | - | - | - | - | 15,940 | - | 0 | 4,192 | 4,192 | 5,068 | 11,481 | 0 | 11,471 | 25,851 | - | 14,604 | 853 | 0 | - | - | 14,719 |
| Mass Flow | lb/hr | - | - | - | - | - | 264,855 | - | 0 | 244,844 | 244,844 | 216,929 | 517,898 | 0 | 517,661 | 912,631 | - | 241,433 | 14,096 | 0 | - | - | 242,212 |
| Vol Flow @Std Cond | barrel/day | - | - | - | - | - | 25,740,830 | - | 0 | 28,864 | 28,864 | 30,423 | 70,081 | 0 | 70,028 | 158,684 | - | 23,582,135 | 1,376,776 | 0 | - | - | 23,768,192 |
| Mass Density @Std Cond | lb/ft3 | - | - | - | - | - | 0.04 | - | 37.91 | 36.26 | 36.26 | 30.48 | 31.59 | 31.60 | 31.60 | 24.58 | - | 0.04 | 0.04 | 0.04 | - | - | 0.04 |
| Actual Liquid Flow | USGPM | - | - | - | - | - | 1267.40 | - | 0.00 | 879.85 | 873.06 | 964.73 | 2250.62 | 0.00 | 2248.18 | 2807.04 | - | 1132.29 | 66.10 | 0.00 | - | - | 1120.01 |
| Mass Density | lb/ft3 | - | - | - | - | - | 26.05 | - | 38.95 | 34.70 | 34.96 | 28.03 | 28.69 | 28.71 | 28.71 | 40.54 | - | 26.58 | 26.59 | 27.06 | - | - | 27.07 |
| Molecular Weight | | - | - | - | - | - | 16.62 | - | 65.59 | 58.40 | 58.40 | 42.81 | 45.11 | 45.13 | 45.13 | 35.30 | - | 16.53 | 16.53 | 16.52 | - | - | 16.52 |
| Mass Heat Capacity | Btu/lb-F | - | - | - | - | - | 0.844 | - | 0.558 | 0.590 | 0.585 | 0.660 | 0.650 | 0.649 | 0.649 | 0.491 | - | 0.865 | 0.865 | 0.866 | - | - | 0.865 |
| Thermal Conductivity | Btu/hr-ft-F | - | - | - | - | - | 0.097 | - | 0.056 | 0.060 | 0.049 | 0.043 | 0.044 | 0.044 | 0.044 | 0.101 | - | 0.109 | 0.109 | 0.113 | - | - | 0.112 |
| Viscosity | cP | - | - | - | - | - | 0.085 | - | 0.204 | 0.139 | 0.138 | 0.079 | 0.083 | 0.083 | 0.083 | 0.663 | - | 0.107 | 0.107 | 0.119 | - | - | 0.118 |
| Surface Tension | dyne/cm | - | - | - | - | - | 9.302 | - | 12.948 | 9.281 | 9.047 | 4.802 | 5.230 | 5.237 | 5.237 | 22.553 | - | 11.689 | 11.694 | 12.743 | - | - | 12.656 |
| Composition | | | | | | | | | | | | | | | | | | | | | | | |
| Comp Mole Frac (CO2) | | 0.000050 | 0.000044 | 0.000044 | 0.000044 | 0.000044 | 0.000044 | 0.000044 | 0.000000 | 0.000000 | 0.000000 | 0.000000 | 0.000000 | 0.000000 | 0.000000 | 0.000000 | 0.000000 | 0.000044 | 0.000044 | 0.000001 | 0.000001 | 0.000001 | 0.000050 |
| Comp Mole Frac (Nitrogen) | | 0.004330 | 0.016535 | 0.016535 | 0.016522 | 0.016522 | 0.016522 | 0.016522 | 0.093073 | 0.093073 | 0.004012 | 0.108371 | 0.093073 | 0.140346 | 0.022483 | 0.093073 | 0.093073 | 0.016522 | 0.016522 | 0.100502 | 0.100502 | 0.100586 | 0.004249 |
| Comp Mole Frac (Methane) | | 0.969815 | 0.960883 | 0.960883 | 0.960788 | 0.960788 | 0.960788 | 0.960788 | 0.289407 | 0.289407 | 0.033380 | 0.333383 | 0.289407 | 0.395233 | 0.131382 | 0.289407 | 0.289407 | 0.960788 | 0.960788 | 0.899357 | 0.899357 | 0.899373 | 0.969755 |
| Comp Mole Frac (Ethane) | | 0.022426 | 0.019588 | 0.019588 | 0.019682 | 0.019682 | 0.019682 | 0.019682 | 0.375727 | 0.375727 | 0.178120 | 0.409658 | 0.375727 | 0.360247 | 0.368978 | 0.375727 | 0.375727 | 0.019682 | 0.019682 | 0.00040 | 0.00040 | 0.00040 | 0.022549 |
| Comp Mole Frac (Propane) | | 0.002371 | 0.002070 | 0.002070 | 0.002080 | 0.002080 | 0.002080 | 0.002080 | 0.000000 | 0.000000 | 0.000000 | 0.000000 | 0.000000 | 0.000000 | 0.000000 | 0.000000 | 0.000000 | 0.002080 | 0.002080 | 0.000000 | 0.000000 | 0.000000 | 0.002384 |
| Comp Mole Frac (i-Butane) | | 0.000449 | 0.000392 | 0.000392 | 0.000394 | 0.000394 | 0.000394 | 0.000394 | 0.063888 | 0.063888 | 0.143580 | 0.050206 | 0.063888 | 0.030181 | 0.114222 | 0.063888 | 0.063888 | 0.000394 | 0.000394 | 0.000000 | 0.000000 | 0.000000 | 0.000451 |
| Comp Mole Frac (n-Butane) | | 0.000407 | 0.000355 | 0.000355 | 0.000357 | 0.000357 | 0.000357 | 0.000357 | 0.057671 | 0.057671 | 0.156083 | 0.040768 | 0.057671 | 0.023254 | 0.109055 | 0.057671 | 0.057671 | 0.000357 | 0.000357 | 0.000000 | 0.000000 | 0.000000 | 0.000409 |
| Comp Mole Frac (i-Pentane) | | 0.000101 | 0.000088 | 0.000088 | 0.000089 | 0.000089 | 0.000089 | 0.000089 | 0.120233 | 0.120233 | 0.484825 | 0.057609 | 0.120233 | 0.030739 | 0.253670 | 0.120233 | 0.120233 | 0.000089 | 0.000089 | 0.000000 | 0.000000 | 0.000000 | 0.000102 |
| Comp Mole Frac (n-Pentane) | | 0.000048 | 0.000042 | 0.000042 | 0.000042 | 0.000042 | 0.000042 | 0.000042 | 0.000000 | 0.000000 | 0.000000 | 0.000000 | 0.000000 | 0.000000 | 0.000000 | 0.000000 | 0.000000 | 0.000042 | 0.000042 | 0.000000 | 0.000000 | 0.000000 | 0.000048 |
| Comp Mole Frac (n-Hexane) | | 0.000003 | 0.000003 | 0.000003 | 0.000003 | 0.000003 | 0.000003 | 0.000003 | 0.000000 | 0.000000 | 0.000000 | 0.000000 | 0.000000 | 0.000000 | 0.000000 | 0.000000 | 0.000000 | 0.000003 | 0.000003 | 0.000000 | 0.000000 | 0.000000 | 0.000003 |

FIG. 8

Heat & Material Balance - Pre-Cooled Twin Expander Nitrogen (PTEXP-$N_2$) Cycle

| Stream | Unit | 114 | 115 | 182 | 208 | 216 | 301 | 320 | 322 | 328 | 330 | 332 | 334 | 338 | 340 | 342 | 346 | 348 | 352 | 354 | 356 | 360 | 364 |
|---|---|---|---|---|---|---|---|---|---|---|---|---|---|---|---|---|---|---|---|---|---|---|---|
| | | | | | | | | | | | | | | | | | | | | | | | |
| | | | | | | | | | | | | | | | | | | | | | | | |
| | | | | | | | | | | | | | | | | | | | | | | | |
| Vapour Fraction | | 1.00 | 1.00 | 1.00 | 1.00 | 1.00 | 1.00 | 1.00 | 1.00 | 1.00 | 1.00 | 1.00 | 0.00 | 0.08 | 1.00 | 1.00 | 1.00 | 1.00 | 1.00 | 0.00 | 1.00 | 0.00 | 1.00 |
| Molecular Weight | | 16.52 | 16.61 | 28.01 | 16.61 | 16.61 | 16.61 | 28.01 | 28.01 | 28.01 | 28.01 | 28.01 | 16.61 | 16.61 | 28.01 | 28.01 | 28.01 | 17.27 | 17.27 | 16.52 | 16.61 | 16.61 | 17.27 |
| Temperature | F | 93.2 | 93.4 | 94.0 | 95.0 | 95.0 | 6.5 | 95.0 | 23.0 | -63.0 | -82.6 | 93.0 | -227.0 | -249.0 | -230.0 | 93.0 | 95.0 | -23.7 | -258.8 | -257.9 | 6.5 | -249.0 | 95.0 |
| Pressure | psia | 856.0 | 856.0 | 609.9 | 1501.5 | 2299.3 | 1100.0 | 1550.0 | 1542.0 | 154'.0 | 614.4 | 609.9 | 1097.6 | 25.0 | 225.9 | 221.4 | 609.9 | 15.0 | 16.0 | 145.0 | 1100.0 | 1090.0 | 856.0 |
| Molar Flow | lbmole/hr | 14,800 | 16,710 | 78,610 | 16,710 | 16,710 | 15,958 | 78,610 | 78,610 | 39,305 | 39,305 | 39,305 | 15,958 | 15,958 | 39,305 | 39,305 | 39,305 | 1,910 | 1,910 | 14,800 | 752 | 752 | 1,910 |
| Mass Flow | lb/hr | 244,523 | 277,514 | 2,202,102 | 277,514 | 277,512 | 265,024 | 2,202,102 | 2,202,102 | 1,101 051 | 1,101,051 | 1,101,051 | 265,024 | 265,024 | 1,101,051 | 1,101,051 | 1,101,051 | 32,991 | 32,991 | 244,521 | 12,488 | 12,488 | 32,991 |
| Heat Flow | Btu/hr | -4.81E+08 | -5.37E+08 | -1.90E+09 | -5.42E+08 | -5.47E+08 | -5.31E+08 | -1.13E+07 | -5.80E+07 | -5.94E+07 | -5.37E+07 | -3.91E+08 | -6.02E+08 | -6.03E+08 | -9.22E+07 | 2.56E+08 | 2.01E+08 | -5.68E+07 | -6.04E+07 | -5.71E+08 | -2.50E+07 | -2.86E+07 | -5.57E+07 |
| Vapor Phase | | | | | | | | | | | | | | | | | | | | | | | |
| Molar Flow | lbmole/hr | 14,800 | 16,710 | 78,610 | 16,710 | 16,710 | 15,958 | 78,610 | 78,610 | 39,305 | 39,305 | 39,305 | - | 1,278 | 39,305 | 39,305 | 39,305 | 1,910 | 1,910 | - | 752 | - | 1,910 |
| Mass Flow | lb/hr | 244,523 | 277,514 | 2,202,102 | 277,514 | 277,512 | 265,024 | 2,202,102 | 2,202,102 | 1,101051 | 1,101,051 | 1,101,051 | - | 22,339 | 1,101,051 | 1,101,051 | 1,101,051 | 32,991 | 32,991 | - | 12,488 | - | 32,991 |
| Std Gas Flow | MMSCFD | 134.53 | 151.90 | 714.57 | 151.90 | 151.90 | 145.06 | 714.57 | 714.57 | 357.28 | 357.28 | 357.28 | - | 11.62 | 357.28 | 357.28 | 357.28 | 17.37 | 17.37 | - | 6.84 | - | 17.37 |
| Actual Gas Flow | ACFM | 1522.86 | 1724.90 | 12644.51 | 929.41 | 588.62 | 910.54 | 5011.68 | 4237.07 | 1598.10 | 3945.33 | 6309.54 | - | 1836.90 | 5817.34 | 17462.89 | 6334.96 | 9890.87 | 4147.10 | - | 42.91 | - | 201.74 |
| Molecular Weight | | 16.52 | 16.61 | 28.01 | 16.61 | 16.61 | 16.61 | 28.01 | 28.01 | 28.01 | 28.01 | 28.01 | - | 17.48 | 28.01 | 28.01 | 28.01 | 17.27 | 17.27 | - | 16.61 | - | 17.27 |
| Mass Density | lb/ft3 | 2.676 | 2.682 | 2.903 | 4.977 | 7.858 | 4.851 | 7.323 | 8.662 | 11.493 | 4.651 | 2.908 | - | 0.203 | 3.155 | 1.061 | 2.897 | 0.056 | 0.133 | - | 4.851 | - | 2.726 |
| Mass Heat Capacity | Btu/lb-F | 0.629 | 0.622 | 0.266 | 0.700 | 0.772 | 0.760 | 0.288 | 0.304 | 0.346 | 0.293 | 0.266 | - | 0.464 | 0.319 | 0.255 | 0.266 | 0.467 | 0.466 | - | 0.760 | - | 0.571 |
| Thermal Conductivity | Btu/hr-ft-F | 0.023 | 0.023 | 0.016 | 0.026 | 0.032 | 0.022 | 0.019 | 0.018 | 0.017 | 0.013 | 0.016 | - | 0.006 | 0.008 | 0.016 | 0.017 | 0.015 | 0.006 | - | 0.022 | - | 0.023 |
| Viscosity | cP | 0.013 | 0.013 | 0.020 | 0.015 | 0.017 | 0.013 | 0.021 | 0.020 | 0.019 | 0.015 | 0.019 | - | 0.005 | 0.009 | 0.019 | 0.020 | 0.010 | 0.005 | - | 0.013 | - | 0.013 |
| Cp/Cv | | 1.488 | 1.487 | 1.469 | 1.642 | 1.772 | 1.891 | 1.553 | 1.634 | 1.846 | 1.633 | 1.469 | - | 1.390 | 1.822 | 1.425 | 1.469 | 1.333 | 1.372 | - | 1.891 | - | 1.477 |
| Z Factor | | 0.891 | 0.893 | 0.991 | 0.842 | 0.816 | 0.753 | 0.996 | 0.963 | 0.883 | 0.914 | 0.990 | - | 0.954 | 0.814 | 0.995 | 0.991 | 0.996 | 0.967 | - | 0.753 | - | 0.911 |
| Liquid Phase | | | | | | | | | | | | | | | | | | | | | | | |
| Molar Flow | lbmole/hr | - | - | - | - | - | - | - | - | - | - | - | 15,958 | 14,680 | - | - | - | 0 | 0 | 14,800 | - | 752 | - |
| Mass Flow | lb/hr | - | - | - | - | - | - | - | - | - | - | - | 265,024 | 242,686 | - | - | - | 0 | 0 | 244,521 | - | 12,488 | - |
| Vol Flow @Std Cond | barrel/day | - | - | - | - | - | - | - | - | - | - | - | 25769949 | 23705376 | - | - | - | 0 | 0 | 23898168 | - | 1214291 | - |
| Mass Density @Std Cond | lb/ft3 | - | - | - | - | - | - | - | - | - | - | - | 0.04 | 0.04 | - | - | - | 0.05 | 0.04 | 0.04 | - | 0.04 | - |
| Actual Liquid Flow | USGPM | - | - | - | - | - | - | - | - | - | - | - | 1268.51 | 1138.46 | - | - | - | 0.00 | 0.00 | 1126.20 | - | 57.36 | - |
| Mass Density | lb/ft3 | - | - | - | - | - | - | - | - | - | - | - | 26.05 | 26.58 | - | - | - | 0.06 | 27.06 | 27.07 | - | 27.15 | - |
| Molecular Weight | | - | - | - | - | - | - | - | - | - | - | - | 16.61 | 16.53 | - | - | - | 17.27 | 16.52 | 16.52 | - | 16.61 | - |
| Mass Heat Capacity | Btu/lb-F | - | - | - | - | - | - | - | - | - | - | - | 0.810 | 0.817 | - | - | - | 0.467 | 0.806 | 0.804 | - | 0.787 | - |
| Thermal Conductivity | Btu/hr-ft-F | - | - | - | - | - | - | - | - | - | - | - | 0.098 | 0.108 | - | - | - | 0.039 | 0.113 | 0.112 | - | 0.108 | - |
| Viscosity | cP | - | - | - | - | - | - | - | - | - | - | - | 0.085 | 0.107 | - | - | - | 0.001 | 0.199 | 0.118 | - | 0.107 | - |
| Surface Tension | dyne/cm | - | - | - | - | - | - | - | - | - | - | - | 9.314 | 11.682 | - | - | - | 0.000 | 12.745 | 12.652 | - | 11.569 | - |
| Composition | | | | | | | | | | | | | | | | | | | | | | | |
| Comp Mole Frac (CO2) | | 0.000050 | 0.000044 | 0.000000 | 0.000044 | 0.000044 | 0.000044 | 0.000000 | 0.000000 | 0.000000 | 0.000000 | 0.000000 | 0.000044 | 0.000044 | 0.000000 | 0.000000 | 0.000000 | 0.000000 | 0.000001 | 0.000044 | 0.000044 | 0.000044 | 0.000001 |
| Comp Mole Frac (Nitrogen) | | 0.004330 | 0.015541 | 1.000000 | 0.015541 | 0.015541 | 0.015541 | 1.000000 | 1.000000 | 1.000000 | 1.000000 | 1.000000 | 0.015541 | 0.015541 | 1.000000 | 1.000000 | 1.000000 | 1.000000 | 0.102392 | 0.015541 | 0.015541 | 0.015541 | 0.102392 |
| Comp Mole Frac (Methane) | | 0.969815 | 0.961555 | 0.000000 | 0.961555 | 0.961555 | 0.961555 | 0.000000 | 0.000000 | 0.000000 | 0.000000 | 0.000000 | 0.961555 | 0.961555 | 0.000000 | 0.000000 | 0.000000 | 0.000000 | 0.897568 | 0.961555 | 0.961555 | 0.961555 | 0.897568 |
| Comp Mole Frac (Ethane) | | 0.022426 | 0.019867 | 0.000000 | 0.019867 | 0.019867 | 0.019867 | 0.000000 | 0.000000 | 0.000000 | 0.000000 | 0.000000 | 0.019867 | 0.019867 | 0.000000 | 0.000000 | 0.000000 | 0.000000 | 0.000040 | 0.019867 | 0.019867 | 0.019867 | 0.000040 |
| Comp Mole Frac (Propane) | | 0.002371 | 0.002100 | 0.000000 | 0.002100 | 0.002100 | 0.002100 | 0.000000 | 0.000000 | 0.000000 | 0.000000 | 0.000000 | 0.002100 | 0.002100 | 0.000000 | 0.000000 | 0.000000 | 0.000000 | 0.000000 | 0.002100 | 0.002100 | 0.002100 | 0.000000 |
| Comp Mole Frac (i-Butane) | | 0.000449 | 0.000398 | 0.000000 | 0.000398 | 0.000398 | 0.000398 | 0.000000 | 0.000000 | 0.000000 | 0.000000 | 0.000000 | 0.000398 | 0.000398 | 0.000000 | 0.000000 | 0.000000 | 0.000000 | 0.000000 | 0.000398 | 0.000398 | 0.000398 | 0.000000 |
| Comp Mole Frac (n-Butane) | | 0.000407 | 0.000360 | 0.000000 | 0.000360 | 0.000360 | 0.000360 | 0.000000 | 0.000000 | 0.000000 | 0.000000 | 0.000000 | 0.000360 | 0.000360 | 0.000000 | 0.000000 | 0.000000 | 0.000000 | 0.000000 | 0.000360 | 0.000360 | 0.000360 | 0.000000 |
| Comp Mole Frac (i-Pentane) | | 0.000101 | 0.000089 | 0.000000 | 0.000089 | 0.000089 | 0.000089 | 0.000000 | 0.000000 | 0.000000 | 0.000000 | 0.000000 | 0.000089 | 0.000089 | 0.000000 | 0.000000 | 0.000000 | 0.000000 | 0.000000 | 0.000089 | 0.000089 | 0.000089 | 0.000000 |
| Comp Mole Frac (n-Pentane) | | 0.000046 | 0.000043 | 0.000000 | 0.000043 | 0.000043 | 0.000043 | 0.000000 | 0.000000 | 0.000000 | 0.000000 | 0.000000 | 0.000043 | 0.000043 | 0.000000 | 0.000000 | 0.000000 | 0.000000 | 0.000000 | 0.000043 | 0.000043 | 0.000043 | 0.000000 |
| Comp Mole Frac (n-Hexane) | | 0.000003 | 0.000003 | 0.000000 | 0.000003 | 0.000003 | 0.000003 | 0.000000 | 0.000000 | 0.000000 | 0.000000 | 0.000000 | 0.000003 | 0.000003 | 0.000000 | 0.000000 | 0.000000 | 0.000000 | 0.000000 | 0.000003 | 0.000003 | 0.000003 | 0.000000 |

FIG. 9

Heat & Material Balance - Pre-Cooled Twin Expander Methane (PTEXP-$CH_4$) Cycle

| Stream | Unit | 114 | 115 | 182 | 208 | 216 | 301 | 320 | 322 | 328 | 330 | 332 | 334 | 338 | 340 | 342 | 346 | 348 | 352 | 354 | 356 | 360 | 364 |
|---|---|---|---|---|---|---|---|---|---|---|---|---|---|---|---|---|---|---|---|---|---|---|---|
| | | | | | | | | | | | | | | | | | | | | | | | |
| Vapour Fraction | | 1.00 | 1.00 | 1.00 | 1.00 | 1.00 | 1.00 | 1.00 | 1.00 | 1.00 | 1.00 | 1.00 | 0.00 | 0.08 | 1.00 | 1.00 | 1.00 | 1.00 | 1.00 | 0.00 | 1.00 | 0.00 | 1.00 |
| Molecular Weight | | 16.52 | 16.61 | 16.91 | 16.61 | 16.61 | 16.61 | 16.91 | 16.91 | 16.91 | 16.91 | 16.91 | 16.61 | 16.61 | 16.91 | 16.91 | 16.91 | 17.26 | 17.26 | 16.52 | 16.61 | 16.61 | 17.26 |
| Temperature | F | 93.2 | 93.4 | 93.9 | 95.0 | 95.0 | 9.0 | 95.0 | -12.0 | 16.1 | -163.3 | 92.5 | -227.0 | -249.0 | -229.5 | 93.0 | 95.0 | -25.4 | -258.8 | -258.0 | 9.0 | -249.0 | 95.0 |
| Pressure | psia | 856.0 | 856.0 | 196.6 | 1278.5 | 1997.0 | 985.0 | 1000.0 | 992.0 | 988.0 | 200.6 | 196.6 | 977.0 | 25.0 | 50.3 | 46.3 | 196.6 | 16.5 | 16.0 | 145.0 | 985.0 | 980.0 | 856.0 |
| Molar Flow | lbmole/hr | 14800 | 16,792 | 48,700 | 16,792 | 16,661 | 15,911 | 48,700 | 48,700 | 26,785 | 21,915 | 21,915 | 15,911 | 15,911 | 26,785 | 26,785 | 26,785 | 1,992 | 1,992 | 14,669 | 750 | 750 | 1,992 |
| Mass Flow | lb/hr | 244,523 | 278,893 | 823,603 | 278,893 | 276,777 | 264,322 | 823,603 | 823,603 | 452,981 | 370,621 | 370,621 | 264,322 | 264,322 | 452,981 | 452,981 | 452,981 | 34,371 | 34,371 | 242,406 | 12,455 | 12,455 | 34,371 |
| Heat Flow | Btu/hr | -4.81E+08 | -5.39E+08 | -1.45E+09 | -5.42E+08 | -5.43E+08 | -5.26E+08 | -1.47E+09 | -1.52E+09 | -8.29E+08 | -7.03E+08 | -6.53E+08 | -6.00E+08 | -6.00E+08 | -8.69E+08 | -7.97E+08 | -7.98E+08 | -5.93E+07 | -6.31E+07 | -5.67E+08 | -2.48E+07 | -2.85E+07 | -5.88E+07 |
| Vapor Phase | | | | | | | | | | | | | | | | | | | | | | | |
| Molar Flow | lbmole/hr | 14,800 | 16,792 | 48,700 | 16,792 | 16,661 | 15,911 | 48,700 | 48,700 | 26,785 | 21,915 | 21,915 | - | 1,335 | 26,785 | 26,785 | 26,785 | 1,992 | 1,992 | - | 750 | - | 1,992 |
| Mass Flow | lb/hr | 244,523 | 278,893 | 823,603 | 278,893 | 276,777 | 264,322 | 823,603 | 823,603 | 452,981 | 370,621 | 370,621 | - | 23,330 | 452,981 | 452,981 | 452,981 | 34,371 | 34,371 | - | 12,455 | - | 34,371 |
| Std Gas Flow | MMSCFD | 134.53 | 152.64 | 442.68 | 152.64 | 151.46 | 144.63 | 442.68 | 442.68 | 243.48 | 199.21 | 199.21 | - | 12.14 | 243.48 | 243.48 | 243.48 | 18.11 | 18.11 | - | 6.82 | - | 18.11 |
| Actual Gas Flow | ACFM | 1522.86 | 1733.24 | 23928.66 | 1116.54 | 679.57 | 1054.51 | 4326.31 | 3020.63 | 1874.68 | 4764.06 | 10739.02 | - | 1919.63 | 20179.71 | 56850.48 | 13189.61 | 9941.06 | 4324.65 | - | 49.69 | - | 210.31 |
| Molecular Weight | | 16.52 | 16.61 | 16.91 | 16.61 | 16.61 | 16.61 | 16.91 | 16.91 | 16.91 | 16.91 | 16.91 | - | 17.47 | 16.91 | 16.91 | 16.91 | 17.26 | 17.26 | - | 16.61 | - | 17.26 |
| Mass Density | lb/ft3 | 2.576 | 2.682 | 0.574 | 4.153 | 6.788 | 4.178 | 3.173 | 4.544 | 4.027 | 1.297 | 0.575 | - | 0.203 | 0.374 | 0.133 | 0.572 | 0.058 | 0.132 | - | 4.178 | - | 2.724 |
| Mass Heat Capacity | Btu/lb-F | 0.629 | 0.622 | 0.522 | 0.678 | 0.769 | 0.733 | 0.604 | 0.726 | 0.667 | 0.612 | 0.522 | - | 0.483 | 0.527 | 0.509 | 0.523 | 0.468 | 0.481 | - | 0.733 | - | 0.571 |
| Thermal Conductivity | Btu/hr-ft-F | 0.023 | 0.023 | 0.020 | 0.025 | 0.029 | 0.021 | 0.023 | 0.020 | 0.021 | 0.010 | 0.020 | - | 0.006 | 0.007 | 0.020 | 0.020 | 0.015 | 0.006 | - | 0.021 | - | 0.023 |
| Viscosity | cP | 0.013 | 0.013 | 0.012 | 0.014 | 0.016 | 0.012 | 0.014 | 0.012 | 0.012 | 0.007 | 0.012 | - | 0.005 | 0.005 | 0.012 | 0.012 | 0.010 | 0.005 | - | 0.012 | - | 0.013 |
| Cp/Cv | | 1.488 | 1.467 | 1.340 | 1.583 | 1.703 | 1.763 | 1.510 | 1.813 | 1.593 | 1.559 | 1..340 | - | 1.369 | 1.397 | 1.311 | 1.339 | 1.333 | 1.357 | - | 1.763 | - | 1.478 |
| Z Factor | | 0.891 | 0.893 | 0.976 | 0.857 | 0.821 | 0.779 | 0..896 | 0.768 | 0.814 | 0.823 | 0.976 | - | 0.954 | 0.921 | 0.994 | 0.976 | 0.996 | 0.957 | - | 0.779 | - | 0.911 |
| Liquid Phase | | | | | | | | | | | | | | | | | | | | | | | |
| Molar Flow | lbmole/hr | - | - | - | - | - | - | - | - | - | - | - | 15,911 | 14,576 | - | - | - | 0 | 0 | 14,669 | - | 750 | - |
| Mass Flow | lb/hr | - | - | - | - | - | - | - | - | - | - | - | 264,322 | 240,993 | - | - | - | 0 | 0 | 242,406 | - | 12,455 | - |
| Vol Flow @Std Cond | barrel/day | - | - | - | - | - | - | - | - | - | - | - | 25593915 | 23536601 | - | - | - | 0 | 0 | 2368692? | - | 1210706 | - |
| Mass Density @Std Cond | lb/ft3 | - | - | - | - | - | - | - | - | - | - | - | 0.04 | 0.04 | - | - | - | 0.05 | 0.04 | 0.04 | - | 0.04 | - |
| Actual Liquid Flow | USGPM | - | - | - | - | - | - | - | - | - | - | - | 1267.79 | 1130.47 | - | - | - | 0.00 | 0.00 | 1116.19 | - | 57.28 | - |
| Mass Density | lb/ft3 | - | - | - | - | - | - | - | - | - | - | - | 25.99 | 26.58 | - | - | - | 0.06 | 27.07 | 27.08 | - | 27.11 | - |
| Molecular Weight | | - | - | - | - | - | - | - | - | - | - | - | 16.61 | 16.53 | - | - | - | 17.26 | 16.52 | 16.52 | - | 16.61 | - |
| Mass Heat Capacity | Btu/lb-F | - | - | - | - | - | - | - | - | - | - | - | 0.846 | 0.865 | - | - | - | 0.944 | 0.866 | 0.865 | - | 0.849 | - |
| Thermal Conductivity | Btu/hr-ft-F | - | - | - | - | - | - | - | - | - | - | - | 0.097 | 0.108 | - | - | - | 0.039 | 0.113 | 0.112 | - | 0.108 | - |
| Viscosity | cP | - | - | - | - | - | - | - | - | - | - | - | 0.085 | 0.107 | - | - | - | 0.001 | 0.119 | 0.118 | - | 0.107 | - |
| Surface Tension | dyne/cm | - | - | - | - | - | - | - | - | - | - | - | 9.313 | 11.682 | - | - | - | 0.000 | 12.746 | 12.662 | - | 11.568 | - |
| Composition | | | | | | | | | | | | | | | | | | | | | | | |
| Comp Mole Frac (CO2) | | 0.000050 | 0.000044 | 0.000000 | 0.000044 | 0.000044 | 0.000044 | 0.000000 | 0.000000 | 0.000000 | 0.000000 | 0.000000 | 0.000044 | 0.000044 | 0.000000 | 0.000000 | 0.000000 | 0.000001 | 0.000001 | 0.000050 | 0.000044 | 0.000044 | 0.000001 |
| Comp Mole Frac (Nitrogen) | | 0.004330 | 0.015824 | 0.072546 | 0.015824 | 0.015867 | 0.015867 | 0.072546 | 0.072546 | 0.072546 | 0.072546 | 0.072546 | 0.015867 | 0.015867 | 0.072546 | 0.072546 | 0.072546 | 0.101228 | 0.101228 | 0.004276 | 0.015867 | 0.015867 | 0.101228 |
| Comp Mole Frac (Methane) | | 0.969815 | 0.961383 | 0.927420 | 0.961383 | 0.961162 | 0.961162 | 0.927420 | 0.927420 | 0.927420 | 0.927420 | 0.927420 | 0.961162 | 0.961162 | 0.927420 | 0.927420 | 0.927420 | 0.898731 | 0.898731 | 0.969639 | 0.961162 | 0.961162 | 0.898731 |
| Comp Mole Frac (Ethane) | | 0.022426 | 0.019771 | 0.000033 | 0.019771 | 0.019925 | 0.019925 | 0.000033 | 0.000033 | 0.000033 | 0.000033 | 0.000033 | 0.019925 | 0.019925 | 0.000033 | 0.000033 | 0.000033 | 0.000041 | 0.000041 | 0.022626 | 0.019925 | 0.019925 | 0.000041 |
| Comp Mole Frac (Propane) | | 0.002371 | 0.002090 | 0.000000 | 0.002090 | 0.002106 | 0.002106 | 0.000000 | 0.000000 | 0.000000 | 0.000000 | 0.000000 | 0.002106 | 0.002106 | 0.000000 | 0.000000 | 0.000000 | 0.000000 | 0.000000 | 0.002392 | 0.002106 | 0.002106 | 0.000000 |
| Comp Mole Frac (i-Butane) | | 0.000449 | 0.000396 | 0.000000 | 0.000396 | 0.000399 | 0.000399 | 0.000000 | 0.000000 | 0.000000 | 0.000000 | 0.000000 | 0.000399 | 0.000399 | 0.000000 | 0.000000 | 0.000000 | 0.000000 | 0.000000 | 0.000453 | 0.000399 | 0.000399 | 0.000000 |
| Comp Mole Frac (n-Butane) | | 0.000407 | 0.000359 | 0.000000 | 0.000359 | 0.000362 | 0.000362 | 0.000000 | 0.000000 | 0.000000 | 0.000000 | 0.000000 | 0.000362 | 0.000362 | 0.000000 | 0.000000 | 0.000000 | 0.000000 | 0.000000 | 0.000411 | 0.000362 | 0.000362 | 0.000000 |
| Comp Mole Frac (i-Pentane) | | 0.000101 | 0.000089 | 0.000000 | 0.000089 | 0.000090 | 0.000090 | 0.000000 | 0.000000 | 0.000000 | 0.000000 | 0.000000 | 0.000090 | 0.000090 | 0.000000 | 0.000000 | 0.000000 | 0.000000 | 0.000000 | 0.000102 | 0.000090 | 0.000090 | 0.000000 |
| Comp Mole Frac (n-Pentane) | | 0.000048 | 0.000042 | 0.000000 | 0.000042 | 0.000043 | 0.000043 | 0.000000 | 0.000000 | 0.000000 | 0.000000 | 0.000000 | 0.000043 | 0.000043 | 0.000000 | 0.000000 | 0.000000 | 0.000000 | 0.000000 | 0.000048 | 0.000043 | 0.000043 | 0.000000 |
| Comp Mole Frac (n-Hexane) | | 0.000003 | 0.000003 | 0.000000 | 0.000003 | 0.000003 | 0.000003 | 0.000000 | 0.000000 | 0.000000 | 0.000000 | 0.000000 | 0.000003 | 0.000003 | 0.000000 | 0.000000 | 0.000000 | 0.000000 | 0.000000 | 0.000003 | 0.000003 | 0.000003 | 0.000000 |

FIG. 10

METHODS AND CONFIGURATIONS FOR LNG LIQUEFACTION

STATEMENT REGARDING FEDERALLY SPONSORED RESEARCH OR DEVELOPMENT

REFERENCE TO A MICROFICHE APPENDIX

Not applicable.

BACKGROUND

Natural gas supply in North America is continually growing mostly due to the production of new shale gas, recent discoveries of offshore gas fields, and to a lesser extent, stranded natural gas brought to market after construction of the Alaska natural gas pipeline. It is believed that shale gas and coal-bed methane will encompass much of the future growth in the energy market.

While natural gas supply is increasing, crude oil supply is depleting as there are no significant new discoveries of oil reserves. If this trend continues, transportation fuel derived from crude oil will soon become cost prohibitive, and alternate renewable fuels (and particularly transportation fuels) will be in higher demand. Moreover, since combustion of natural gas also produces significantly less carbon dioxide ($CO_2$) as compared to other fossil materials (e.g., coal or gasoline), use of natural gas is even more desirable. Natural gas used for transportation fuel must be in a denser form, either as compressed natural gas (CNG) or liquefied natural gas (LNG). CNG is produced by compression of natural gas to very high pressures of about 3000 to 4000 psig. However, even at such pressures, the density of CNG is relatively low, and storage at high pressure requires heavy weight vessels which could be potentially a hazard. Conversely, LNG has a significantly higher density and can be stored at relatively low pressures of about 20 to 100 psig. Additionally, LNG is a safer fuel than CNG, as it is at a lower pressure and not combustible until it is vaporized and mixed with air in the proper ratio. Nevertheless, CNG is more common than LNG as a transportation fuel, mainly due to the high cost of liquefaction and the lack of infrastructure to support LNG fueling facilities.

LNG can be used to replace diesel and is presently used in many heavy-duty vehicles, including refuse haulers, grocery delivery trucks, transit buses, and coal miner lifters. To increase the LNG fuel marketability, small to mid-scale LNG plants must be constructed close to both pipelines and LNG consumers, as long-distance transfer of LNG is costly and therefore often not economical. Such small to mid-scale LNG plants are generally designed to produce 0.1 to 1.5 million metric tons per year (mmtpy). Moreover, such small to mid-scale LNG plants must be simple in design, easy to operate, and sufficiently robust to support an unmanned operation. Likewise, it would be desirable to integrate liquefaction with LNG truck fueling operations to allow for even greater delivery flexibility.

Various refrigeration processes are implemented for LNG liquefaction. The most common of these refrigeration processes are the cascade process, the mixed refrigerant process, and the propane pre-cooled mixed refrigerant process. While these methods are energy efficient, such methods are often complex and require circulating several hydrocarbon refrigerants or mixed hydrocarbon refrigerants. Unfortunately, such refrigerants (e.g., propane, ethylene, and propylene) are explosive and hazardous in the event of leakage.

There are several recent innovations in LNG plant design. For example, U.S. Pat. No. 5,755,114 to Foglietta teaches a hybrid liquefaction cycle which includes a closed loop propane refrigeration cycle and a turboexpander cycle. Compared to other liquefaction processes, the liquefaction process has been simplified, but is still unsuitable and/or economically unattractive for small to mid-scale LNG plants. U.S. Pat. No. 7,673,476 to Whitesell discloses a compact and modular liquefaction system that requires no external refrigeration. The system uses gas expansion by recycling feed gas to generate cooling. While this design is relatively compact, operation of the recycle system is complicated, and the use of hydrocarbon gas for cooling remains a safety concern. U.S. Pat. No. 5,363,655 to Kikkawa teaches the use of a gas expander and plate and fin heat exchangers for LNG liquefaction. While providing several advantages, such process is still too complex and costly for small to mid-scale LNG plants.

U.S. Pat. No. 10,330,382 to John Mak, Jacob Thomas et. al. teaches the use of a gas expander, compressor and plate and fin heat exchangers for "Systems and methods for LNG production with propane and ethane recovery". Conventional gas compression and expansion techniques are prior art technologies that have been applied to natural gas pre-cooling in other gas processing facilities for many years, it has not been used for precooling the treated gas to LNG liquefaction until recently.

U.S. Pat. No. 10,605,522 to John Mak, Jacob Thomas et. al. teaches the use of a pre-cooling system for natural gas and a gas expander, compressor and plate & fin heat exchangers for LNG liquefaction "Methods and configurations for LNG liquefaction". While providing several advantages over other conventional LNG liquefaction process, this process's thermal efficiencies are still lower than that of the larger baseload LNG plants and higher operational expenses (OPEX) for small to mid-scale LNG plants.

Hydrocarbon drilling and production systems can include the extraction of natural gas from wellbores in subterranean earthen formations. For ease of transport or storage, the natural gas can be liquefied. The liquefaction process includes condensing the natural gas into a liquid by cooling, or refrigeration allowing LNG to be moved and stored more efficiently. Prior to condensing, the natural gas can be treated or processed to remove certain components such as water, dust, mercury, acid gases such as hydrogen sulfide and carbon dioxide, heavy hydrocarbons, and other components.

Liquefaction of LNG requires significant quantities of thermal energy, and typical LNG liquefaction facilities employ external or internal refrigerant sources to liquefy LNG prior to storage and delivery. For example, external refrigerant sources include a mixed refrigerant or single gaseous refrigerant Nitrogen ($N_2$) or internal refrigerant, Methane ($CH_4$)—boil off gas (BOG) generated from the LNG itself. Depending on the particular refrigerant media, the LNG cryogenic heat exchangers may be configured as plate fin, printed circuit or spiral wound heat exchangers.

SUMMARY

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

To resolve the problems mentioned above, an object of the present invention is to provide configurations and methods of LNG liquefaction, preferably using ambient air, sea water, or other low-grade heat sources.

In an embodiment, a system for pre-cooling a natural gas stream to a liquefaction plant may comprise a compressor configured to receive a first natural gas stream at a first pressure and produce a second natural gas stream at a second pressure; an exchanger, wherein the exchanger is configured to receive the second natural gas stream at the second pressure and cool the second natural gas stream to produce a cooled natural gas stream; and an expander, wherein the expander is configured to receive the cooled natural gas stream and expand the cooled natural gas stream from the second pressure to a third pressure.

In an embodiment, a method may comprise compressing and cooling a natural gas stream to produce a compressed natural gas stream, wherein the natural gas stream is at a second pressure and a second temperature; and expanding the compressed natural gas stream to produce a chilled natural gas stream, wherein the chilled natural gas stream is at a third pressure and a third temperature, wherein the second temperature is higher than the third temperature.

In an embodiment, the present disclosure is related to small scale to mid-scale LNG liquefaction plants with capacities of 0.1 to 1.5 mmtpy and is also applicable to various types of liquefaction processes including gas $N_2$ or $CH_4$—BOG expander cycles, single mixed refrigerant (SMR) cycles, and for pre-cooling of the natural gas feed to large baseload (>5 mmtpy) LNG facilities, either for grass-roots installation or debottlenecking an existing facility.

In other embodiments, LNG liquefaction plant or system, where the working fluid for the cold box is an external refrigerant $N_2$ or single mixed refrigerant (SMR) or an internal refrigerant, $CH_4$ such as LNG vapor or BOG.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

For a detailed description of exemplary embodiments, reference will now be made to the accompanying drawings in which:

FIG. 4 is a table showing LNG Liquefaction & Refrigeration Summary in comparison with other major licensed technologies for single mixed refrigerant (SMR) and Gas (Nitrogen & Methane) Expander cycle LNG liquefaction process at an average Ambient Temperature 77° F. with natural gas feed precooling of this invention for this patent application;

FIG. 8 is a heat and material balances of the pre-cooled single mixed refrigerant (PSMR) process; and FIG. 9 is a heat and material balances of the pre-cooled twin expander nitrogen (PTEXP-$N_2$) cycle; and FIG. 10 is a heat and material balances of the pre-cooled twin expander methane (PTEXP-$CH_4$) cycle.

DETAILED DESCRIPTION

Figure 1:
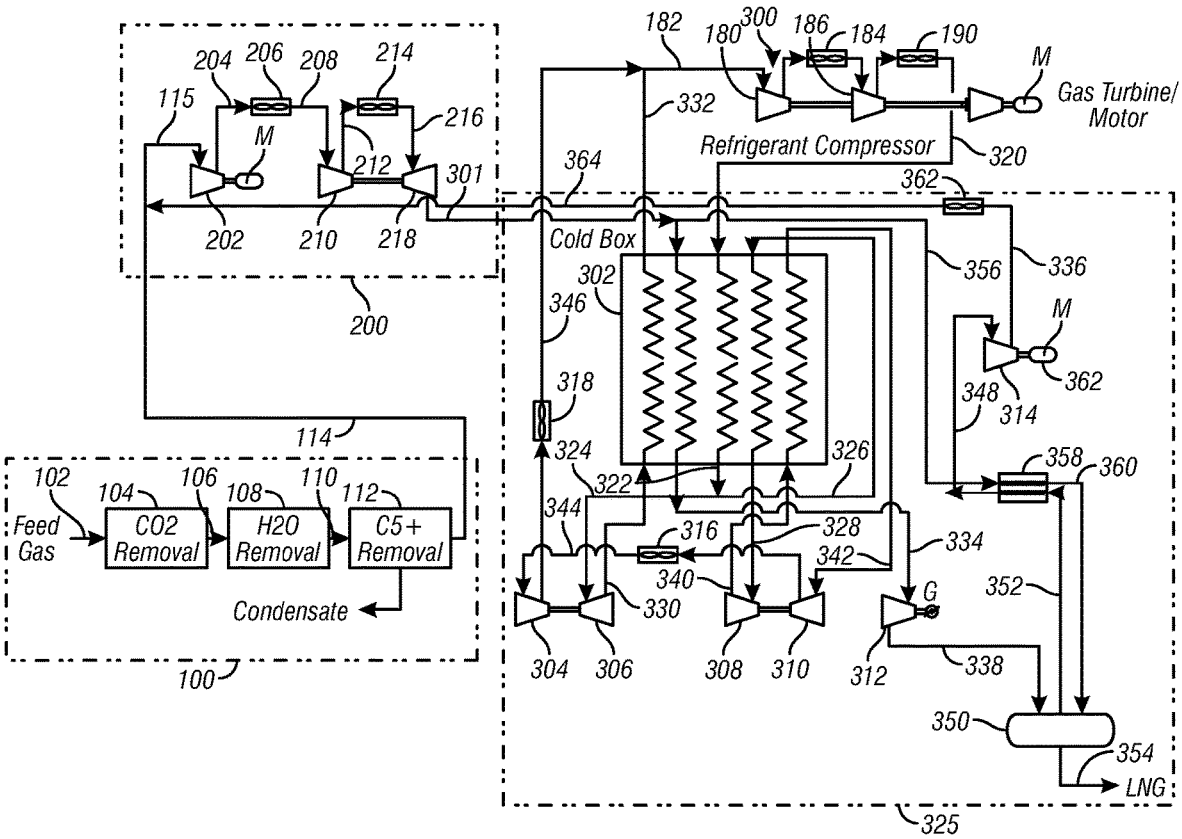
FIG. 1 is an equipment and process flow diagram for an embodiment of a LNG liquefaction plant or system using an external refrigerant $N_2$ or internal refrigerant $CH_4$—BOG in accordance with principles disclosed herein.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

The field of the systems and methods described herein is LNG liquefaction, especially regarding the gas compression and expansion cooling methods to precool feed gas to a LNG liquefaction plant. The present disclosure is related to small scale to mid-scale LNG liquefaction plants with capacities of 0.1 to 1.5 million tons per year (mmtpy) and is also applicable to various types of liquefaction processes including N2 or CH4—BOG expander cycles and single mixed refrigerant (SMR) cycle, and for pre-cooling of the natural gas feed to large baseload (>5 mmtpy) LNG facilities, either for grass-roots installation or debottlenecking an existing facility.

With the exploration and development of unconventional resources for energy such as shale gas, tight gas, and coal bed methane gas, natural gases are becoming a main energy source for the near future. Shale gas fields are located in remote areas and in dispersed locations, which would require construction of costly pipelines to bring the gas to the consumers. In many instances, it is more economical to liquefy the natural gas on site so that it can be transported to the consumers by trucks or tankers. These unconventional fields are generally smaller than "traditional" gas reservoirs, such that application of complex LNG liquefaction processes is not appropriate.

Small to mid-scale LNG plants are typically defined with liquefaction capacities from 0.1 to 1.5 mmtpy. These smaller plants must be simple in design, safe, easy to operate, and robust with consideration of limited staffing in plant operation. The simpler processes, such as the single mixed refrigerant (SMR) cycle or the gas (N2 or CH4 BOG) expander cycle, are preferred.

Various refrigeration processes can be used for LNG liquefaction. For example, some refrigeration processes can include the cascade process, the mixed refrigerant process, and the propane pre-cooled mixed refrigerant process. Most of the world's baseload LNG plants (i.e., plants producing more than 5.0 mmtpy) use propane precooled mixed refrigerant (C3MR) cycle and dual mixed refrigerant (DMR) cycle or optimized cascade refrigerant (OCP) cycle using multiple pure refrigerants. While these known methods are energy efficient, such methods are often complex, requiring circulating several levels of pure hydrocarbon refrigerants or multiple mixed hydrocarbon refrigerants. In almost all cases, the liquefaction process requires a precooling stage mostly supplied by propane refrigerant or ethane-propane mixed refrigerant. Several precooling refrigerants are also applicable, such as ammonia, carbon dioxide, and/or lithium bromide (LiBr) for improving the liquefaction cycle efficiency. However, such precooling systems are complex and costly to operate, and in offshore situations, such as Floating LNG (FLNG), the real estate for installing these precooling units may not be available.

Most in the industry regard the gas (N2 and CH4—BOG) expansion cycle as a well-established, robust and easy-to-operate technology, albeit one that was once considered less efficient than the SMR cycle. However, unique factors in today's LNG marketplace have made the N2 and CH4—BOG expansion cycle a process of choice in many new, small—mid scale LNG markets. The main advantage of the N2 and CH4—BOG expansion cycle is that there is no hydrocarbon liquid inventory, such that the design is inherently safe. Being a gas phase operation, there are no two-phase distribution problems (that may be associated with the SMR cycle), and the N2 and CH4—BOG system can be turned down as needed to meet the demand curve. For offshore applications, the N2 and CH4—BOG system performance is not impacted by ship motion and is the process of choice for ship-based floating liquefaction (FLNG) plants. In a congested space, flammable inventories are frequently occupied by personnel, and there is a strong incentive to minimize the risk of catastrophic loss, and hence the N2 and CH4—BOG expander cycle is the process of choice.

Moreover, pipeline feed gas composition frequently varies. This feed gas variation can impact the overall performance of the liquefaction plant. For the mixed refrigerant (SMR, C3MR, DMR) cycle, the selection of specially mixed, multi-component hydrocarbon refrigerant must be adjusted to match the feed gas variation to maintain high refrigeration efficiency. If the refrigerant combination is not adjusted frequently, then the mixed refrigerant cycle's advantage over the N2 and CH4—BOG cycle may vanish.

The N2 or CH4—BOG cycle, on the other hand, is significantly more flexible than the mixed refrigerant cycle in minimizing overall effects on efficiency and performance for ranges of ambient air/cooling water temperatures and natural gas feed compositions. The N2 and CH4—BOG cycle uses gas with relatively constant composition as the refrigerant; therefore, no adjustments are required for changing feed gas composition.

Over the years, gas (N2 and CH4—BOG) expander cycle efficiency has been improved by advances in equipment designs, such as turbo-expanders, compressors, heat exchangers, brazed aluminum heat exchangers, and process configurations on multi-stage design. While equipment efficiency has reached its limit, the next step to further the improvement is to develop an economical method in precooling the feed gas to eliminate the temperature approach inefficiency.

Thus, while all or almost all of the known configurations and methods provide some advantages over previously-known configurations, various disadvantages remain. Among the choice of small and mid-scale liquefaction plants, single mixed refrigerant and gas (N2 or CH4—BOG) expander cycles are suitable; however, their thermal efficiencies are lower than that of the larger baseload LNG plants unless a feed gas cooling method is used.

The present systems and methods are directed to feed gas compression, expansion, and cooling systems that can be used to increase the natural gas liquefaction efficiency, resulting in lowering liquefaction power consumption and/or increasing plant capacity. Most preferably, natural gas (e.g., delivered from a pipeline) is compressed, expanded, and cooled providing a chilled high pressure gas to the liquefaction plant. With the contemplated methods and configurations, the specific power consumption for LNG liquefaction is significantly reduced to 255-285 kW/ton, which is similar to dual mixed refrigerant (DMR) and significantly lower than propane pre-cooled mixed refrigerant (C3MR) and other single mixed refrigerant (SMR) liquefaction and gas (N2) expander cycle process, typically in the range of 275-350 kW/ton.

In some configurations, the compression system consists of a compressor driven by the expander, which lowers the feed gas temperature to the liquefaction plant. Preferably, feed gas is compressed, with inter-cooling, to at least 2,000 to 3,000 psig, and then expanded to 900-1,100 psig, providing a feed gas with a chilled temperature at least 5° F. to −50° F. This is especially necessary when existing LNG liquefaction plants are required to increase throughput to meet demands, the additional chilling can debottleneck the system, providing more available power for refrigerant compressor and increasing the refrigerant and the LNG liquefaction throughput without resorting to revamping the existing facility.

The term "expander compressor" as used herein refers to single-stage or multi-stage expander compressors. The compressor typically comprises an axial compressor, a centrifugal compressor, or like compressors with a polytropic efficiency of 83-85% or higher, while the expander can be an axial machine with adiabatic efficiency of 84-88% or higher.

FIG. 1 illustrates a gas treating process 100 where a natural gas stream 102 is fed to an acid gas removal unit 104. The treated gas stream 106 may be fed to a molecular sieve dryer and mercury removal unit 108 to produce a dried gas stream 110. The dried gas stream may be fed to a heavies (C5+) removal unit 112 and treated gas 114 is fed to a pre-cooling process 200.

In pre-cooling process 200, treated gas 114 from gas treating process and the BOG recycle 364 and the combined stream 115 is fed to a compressor 202, where the compressor 202 may be driven by an electric motor. The outlet gas stream 204 which may be cooled in an air cooler 206 producing a cooled gas stream 208. The cooled gas stream 208 may be further compressed by compressor 210, where the compressor 210 may be driven by an expander 218, producing stream 212. Stream 212 may be cooled in another air cooler 214, producing a high-pressure gas stream 216. The high pressure gas stream 216 may be expanded in expander 218 to produce cold high pressure gas stream 301, where the cold high pressure gas stream 301 may be controlled to appropriate conditions for entering the LNG liquefaction process 300 cryogenic heat exchanger (cold box) 302.

The low feed gas temperature coupled with high pressure can reduce the power required by the refrigeration compressor in the liquefaction process. The refrigeration compressor is typically driven by at least two compression stages. The refrigerant fluid can be N2 or CH4—BOG in a multiple stage expander cycle.

In other embodiments, LNG liquefaction plant or system, where the working fluid for the cold box is an external refrigerant N2 or an internal refrigerant, CH4 such as LNG vapor or BOG. Referring now to FIG. 1, LNG liquefaction plant or system 300 includes a gas treatment system 100, pre-cooling system 200 and a heat exchanger system 325.

The heat exchanger system 325 includes a cold box or cryogenic exchanger 302 fed a natural gas stream by a conduit 301. The natural gas stream can be treated as described above with reference to the treatment system 100 and pre-cooling system 200. In some embodiments, the treated gas stream in the conduit 301 is at a pressure of 985 psig to 1,100 psig and a temperature of 5° F. to 10° F. The treated gas stream is liquefied and sub-cooled in the cold box 302 to produce a LNG stream in a conduit 334. In some embodiments, the LNG stream is a pressure of 970-1,095 psig and a temperature of −225 to −235° F. The LNG stream is directed to an expander or hydraulic turbine 312 to produce an expanded LNG stream in a conduit 338. In some embodiments, the LNG stream is expanded to about atmospheric pressure (>1.0 psig), and in further embodiments is sub-cooled to −258° F. and stored in a storage tank 350 for LNG export in a conduit 354.

A compressor discharge stream with compressed and cooled refrigerant flows in a conduit 320 to the cold box 302 for liquefaction and sub-cooling of LNG. After the cold box 302, the refrigerant stream flows through a conduit 322 and is split between conduits 324 and 326. In some embodiments, the refrigerant stream is split at a ratio of 1:1 or lower for the conduit 324 as compared to the conduit 326. A first stream portion in the conduit 324 is directed to an expander 306 which in turn drives a compressor 304. The combination of 306, 304 may also be referred to as an expander-compressor or compander. The second stream portion in the conduit 326 is directed back through and out of the cold box 302 in a conduit 328 to an expander 308 which drives a compressor 310 (i.e., expander-compressor or compander 308/310). It is noted that, unlike the first stream portion 324, the second stream portion 326 is fed to the cold box 302 to thereby produce the stream 328 which is fed to the expander 308. Consequently, a first expanded stream, or low pressure working fluid vapor, flows from the expander 306 in a conduit 330 and a second expanded stream, or low pressure working fluid vapor, flows from the expander 308 in a conduit 340, both to the cold box 302. In some embodiments, the first and second expanded streams are at temperatures of about −225° F. to −235° F. and are used in respective heat exchange stages to facilitate LNG liquefaction in the cold box 302. In some embodiments, the arrangement described can also be referred to as a twin expander-compressor or twin compander assembly, used for compression of the external N2 or internal CH4—BOG refrigerant used as the working fluid.

The refrigeration content of the second expanded stream in the conduit 340 is used for liquefaction in the cold box 302 to thereby produce a second warm N2 or CH4—BOG vapor in a conduit 342 (or a warm intermediate stage working fluid vapor). The vapor stream is then compressed in the compressor 310 to produce a compressed stream in a conduit 344, which is further compressed in the compressor 304 to produce a compressed stream in a conduit 346 that is recycled back to the first stage refrigerant compressor 180. Conduits 344, 346 can also include air coolers 316, 318 to further cool the compressed refrigerant streams. Similarly, the refrigeration content of the first expanded stream in the conduit 330 is used for liquefaction in the cold box 302 to thereby produce a first warm refrigerant vapor (N2 or CH4—BOG) in a conduit 332 (or, a warm intermediate stage working fluid vapor) that is combined with stream 346 as common suction stream 182 and recycled back to the first stage refrigerant compressor 180. Consequently, the warm refrigerant vapor (N2 or CH4—BOG) stream is the working fluid and provides refrigeration content in the cold box 302 for liquefaction. In some embodiments, the first expanded stream in the conduit 330 is at a pressure of about 200-600 psia, and the second expanded stream in the conduit 340 is at a pressure of about 50-225 psia (lower pressure for CH4—BOG and higher pressure for N2 cycle).

LNG vapor or BOG stream is directed from the storage tank 350 in a conduit 352 to an End Flash Gas (EFG) Exchanger 358, and the LNG vapor stream includes refrigeration content. The refrigeration content of the LNG vapor stream 352 can be used to increase/supplement LNG production by about 2.5-4%, prior to recycling it back to the front end or use it as fuel gas. A slip stream 356 from the treated gas 301 conduit is send to the EFG Exchanger 358, where it is liquefied and subcooled to produce additional LNG stream 360 to the storage tank 350. The LNG vapor stream 352 is directed through the EFG Exchanger 358 and out in a conduit 348. The conduit 348 directs the LNG vapor stream to a compressor 314. The compressed BOG stream is cooled in air cooler 362 and recycled to the conduit 364 to the feed compressor 202. In some embodiments, power for the compressor 314 can be provided by an electric motor 356.

Figure 2:
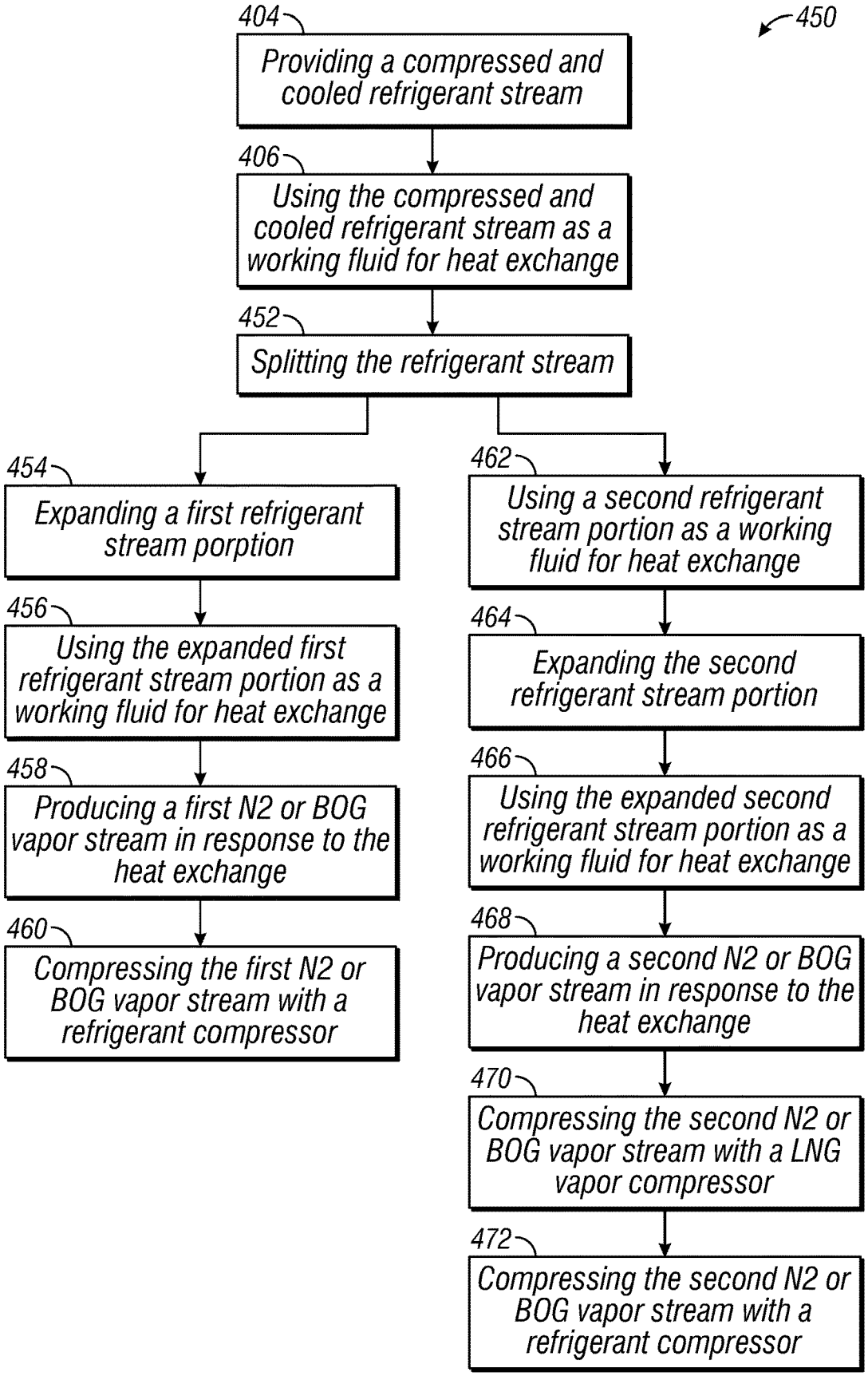
FIG. 2 is a flow chart for an embodiment of a method of LNG liquefaction using an external or internal refrigerant in accordance with principles disclosed herein.

Referring now to FIG. 2, an extension of the method 300 is illustrated as a method 450 including the steps 404 and 406. After the heat exchange of step 406, the refrigerant stream is split at 452. Next, the method 450 includes expanding a first refrigerant portion 454, using the expanded first refrigerant stream portion as a working fluid for heat exchange 456, producing a first N2 or CH4—BOG vapor stream in response to the heat exchange 458, and compressing the first N2 or CH4—BOG vapor stream with a refrigerant compressor, such as, for example, using the stream 332 directed into the second stage refrigerant compressor 188. Then, the method 450 also includes using a second refrigerant stream portion as a working fluid for heat exchange 462, expanding the second refrigerant portion 464, using the expanded second refrigerant stream portion as a working fluid for heat exchange 466, producing a second refrigerant vapor stream in response to the heat exchange 468, compressing the second N2 or CH4—BOG vapor stream with a compressor (such as, for example, with the compressors 304, 310 that are part of the heat exchanger system 325), and compressing the second N2 or CH4—BOG vapor stream with a refrigerant compressor (such as, for example, the first stage refrigerant compressor 180).

Figure 3:
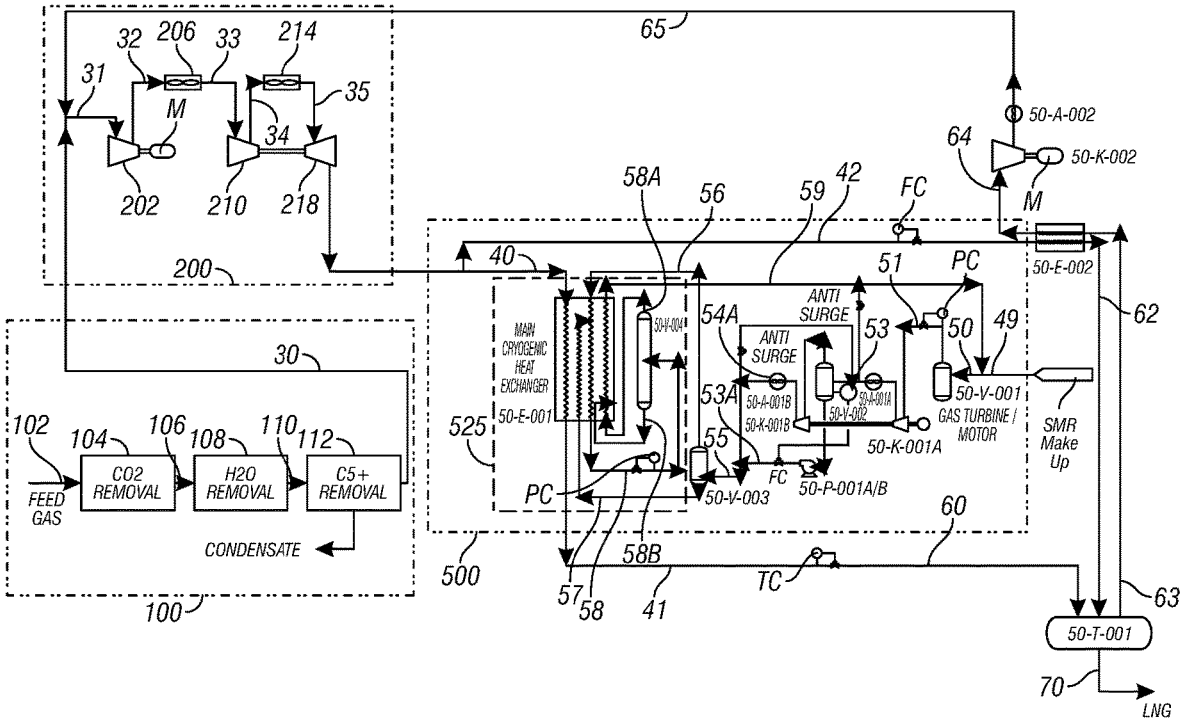
FIG. 3 is an equipment and process flow diagram for an embodiment of a LNG liquefaction plant or system using an external refrigerant, single mixed refrigerant (SMR) in accordance with principles disclosed herein.

In other embodiments, LNG liquefaction plant or system, where the working fluid for the cold box is an external refrigerant, single mixed refrigerant (SMR). Referring now to FIG. 3, LNG liquefaction plant or system 500 includes a gas treatment system 100, pre-cooling system 200 and a heat exchanger system 525. Feed Gas Treating system 100 and pre-cooling system 200 given in FIG. 1 is identical to the system in FIG. 3 and therefore not described again here.

A treated gas stream is directed through the conduit 40 and into the cold box 50-E-001 of the heat exchanger unit 525. In some embodiments, the treated gas stream is at a pressure of 1,100 psig and a temperature of −2° F. A refrigerant is directed from the second refrigerant compressor 50-K-001B and its discharge stream in the conduit 54A/55 to the separator 50-V-003 where the stream is split into a liquid stream in the conduit 57 and a vapor stream in the conduit 56. In some embodiments, the refrigerant working fluid is a single mixed refrigerant (SMR). As will be readily appreciated, the composition of the working fluid is generally determined by the specific composition of the feed gas, the LNG product, and the desired liquefaction cycle pressures. It may also be desirable to vary the working fluid compositions and/or cycle operating pressures as necessary to maximize liquefaction.

The refrigerant streams 56, 57 are used for liquefaction and sub-cooling of LNG in the cold box 50-E-001. The liquid stream 57 and the vapor stream 56 are directed to the cold box 50-E-001 in their respective exchanger stages to facilitate LNG liquefaction and to thereby produce cooled liquid streams in the conduits 58. The cooled liquid streams 58 are directed through a JT valve and expanded. In some embodiments, the cooled liquid streams are expanded to 50 psig. The expanded stream is directed to the separator 50-V-004 and the vapor stream in conduit 58A and the liquid stream in conduit 58B are then fed to next heat exchange stage of the cold box 50-E-001 and the conduit 59 from the cold box is recycled back to the first refrigerant compressor 50-K-001A via suction drum 50-V-001. Refrigerant is from the first refrigerant compressor 50-K-001A and its discharge stream in the conduit 53 to the separator 50-V-002 where the stream is split into a liquid stream in the conduit 53A to a pump 50-P-001A/B and a vapor stream to the second refrigerant compressor 50-K-001B in the conduit 54A and both discharge stream in the conduit 53A and 54 A are then combined in conduit 55 and directed to the separator 50-V-003 where the stream is split into a liquid stream in the conduit 57 and a vapor stream in the conduit 56 are recycled back to the cold box 50-E-001. Consequently, a liquefied and sub-cooled LNG stream is generated in the cold box 50-E-001 and directed through the conduit 41. In some embodiments, the LNG stream 41 is at a pressure of 950 psig and −227° F. from the cold box 50-E-001 and is expanded across a JT valve to produce a LNG product stream in the conduit 60. In some embodiments, the LNG product stream 60 is brought to nearly atmospheric pressure (>1.0 psig) and further sub-cooled to −258° F. and stored in the storage tank 50-T-001 for LNG export in the conduit 70.

LNG vapor or BOG stream is directed from the storage tank 50-T-001 in a conduit 63 to an End Flash Gas (EFG) Exchanger 50-E-002. The refrigeration content of the LNG vapor stream 63 can be used to increase/supplement LNG production by about 2.5-4%, prior to recycling it back to the front end or use it as fuel gas. A slip stream 42 from the treated gas 40 conduit is send to the EFG Exchanger 50-E-002, where it is liquefied and subcooled to produce additional LNG stream 62 to the storage tank 50T-001. The LNG vapor stream 63 is directed through the EFG Exchanger 50-E-002 and out in a conduit 64. The conduit 64 directs the LNG vapor stream to a compressor 50-K-002. The compressed BOG stream is cooled in air cooler 50A-002 and recycled to the conduit 65 to the feed gas compressor 202 in pre-cooling system 200. In some embodiments, power for the compressor 50-K-002 can be provided by an electric motor.

As described above, in various embodiments the refrigeration content of the refrigerant SMR can be used in the LNG facility by using the refrigerant SMR as a working fluid, wherein the refrigerant SMR is compressed, cooled, expanded in a JT valve, and sub-cooled in multiple heat exchange stages in the cold box 50-E-001 (e.g., heat exchange stages of 56, 57, 58A, 58B & 58).

Referring to FIG. 4, is a table showing LNG Liquefaction & Refrigeration Summary (Average Ambient Temperature 77° F.) for single mixed refrigerant (SMR) and Gas (Nitrogen & Methane) Expander cycle LNG liquefaction with natural gas precooling of this invention and optimum proprietary selection of refrigerant components, composition, operating conditions (temperature & pressure) for this patent application, which offers the lowest possible specific refrigerant power by 17% for SMR and by 30% for N2 expander cycle in comparison with other major licensed technologies.

Figure 5:
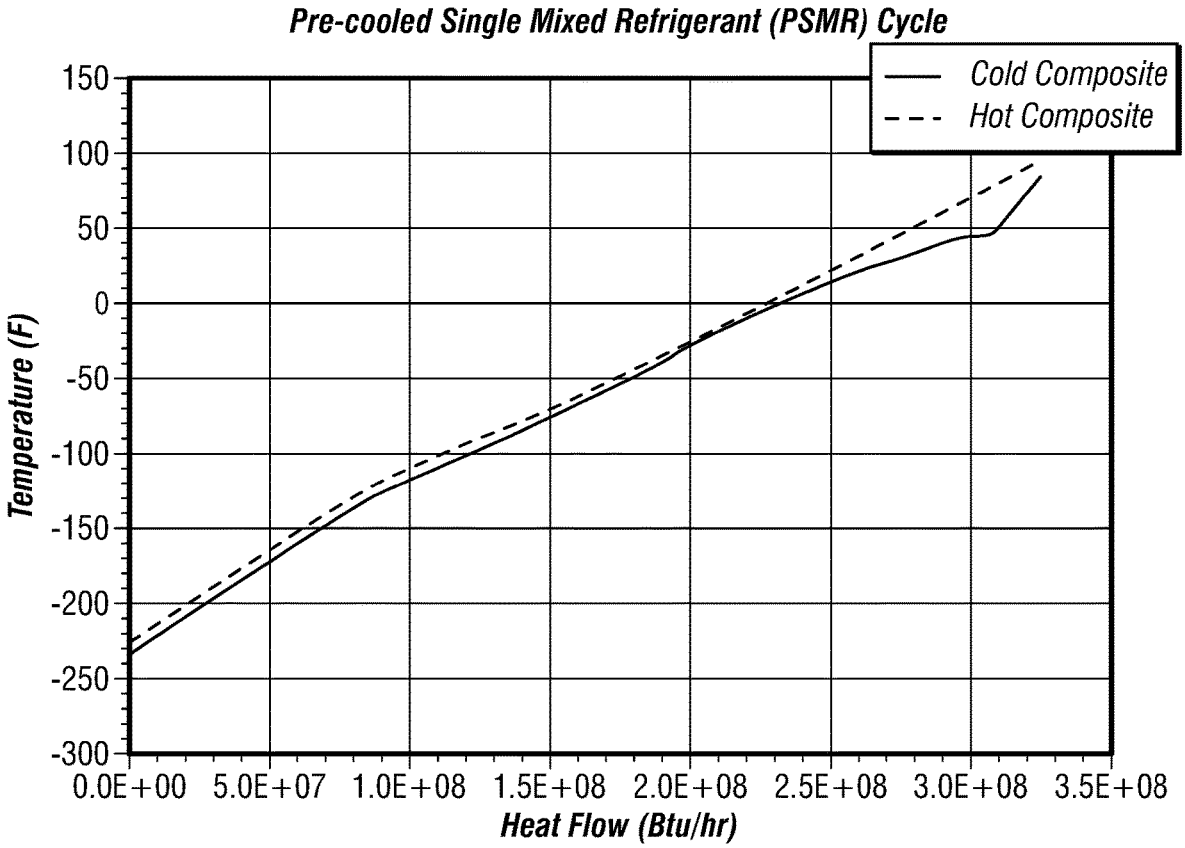
FIG. 5 is a diagram showing the composite heat curves between LNG and an external refrigerant, single mixed refrigerant (SMR) as a working fluid using a cold box.

Referring to FIG. 5, is a graph shows a cold composite heat curve for the external refrigerant SMR working fluid and a hot composite heat curve for the LNG, using heat flow (btu/hr) as a function of temperature (° F.).

Figure 6:
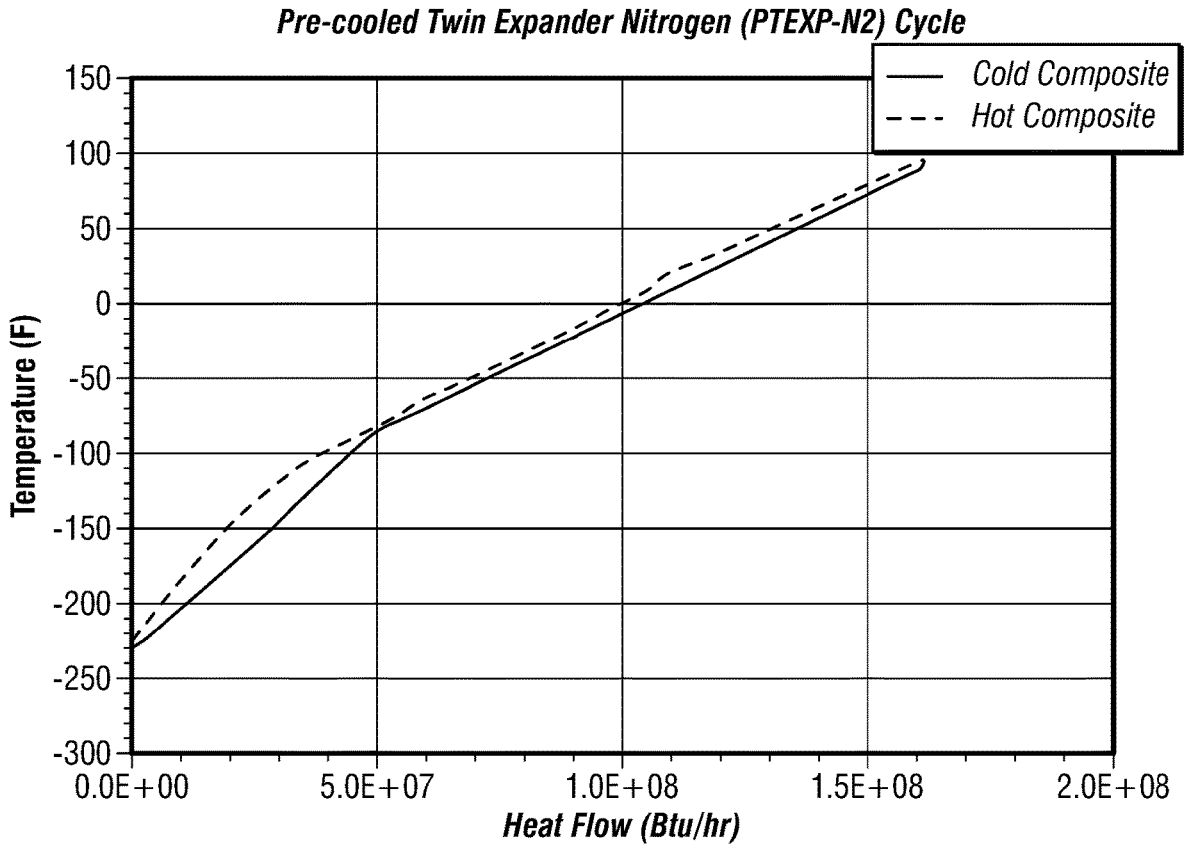
FIG. 6 is a diagram showing the composite heat curves between LNG and an external refrigerant $N_2$ as a working fluid using a cold box.

Referring to FIG. 6, is a graph shows a cold composite heat curve for the external refrigerant N2 working fluid and a hot composite heat curve for the LNG, using heat flow (btu/hr) as a function of temperature (° F.).

Figure 7:
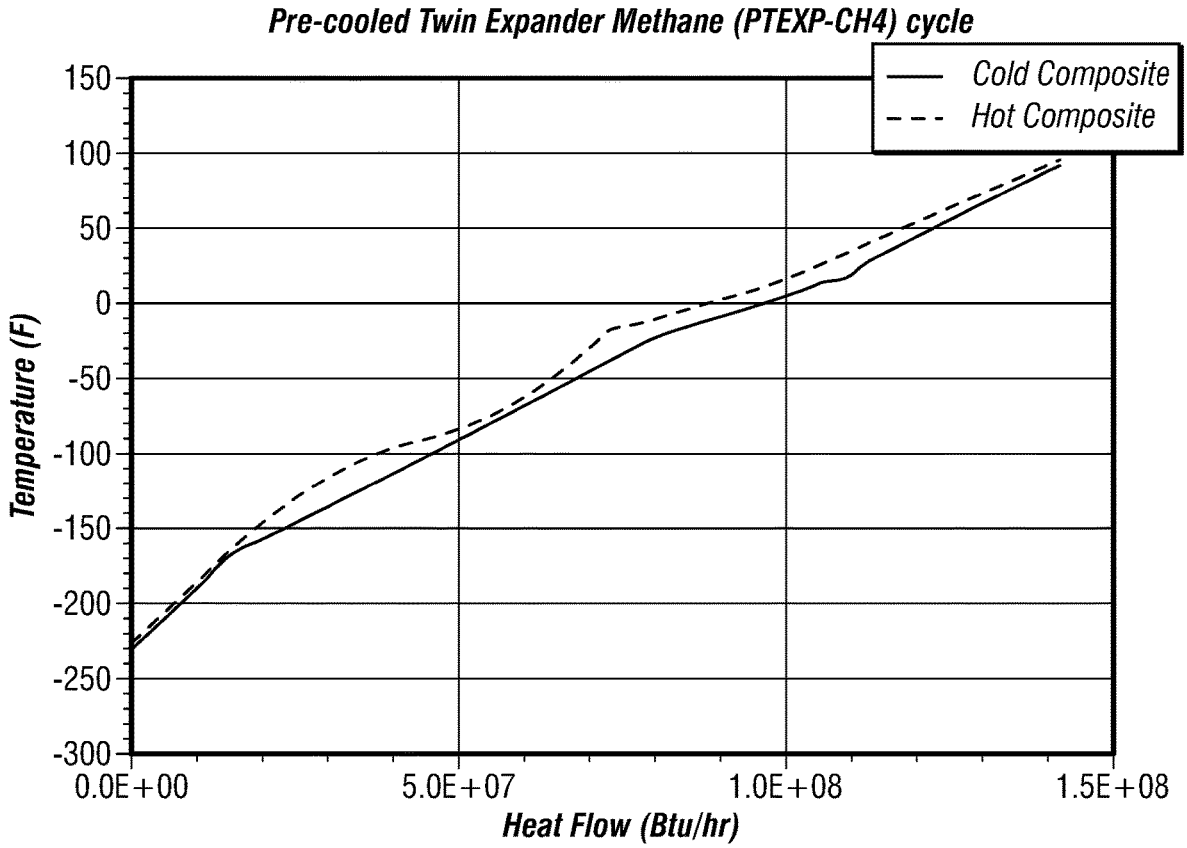
FIG. 7 is a diagram showing the composite heat curves between LNG and an internal refrigerant $CH_4$ (BOG) as a working fluid using a cold box.

Referring to FIG. 7, is a graph shows a cold composite heat curve for the internal refrigerant CH4—BOG working fluid and a hot composite heat curve for the LNG, using heat flow (btu/hr) as a function of temperature (° F.).

Referring to FIG. 8, is the heat and material balances of the pre-cooled single mixed refrigerant (PSMR) cycle.

Referring to FIG. 9, is the heat and material balances of the pre-cooled twin expander nitrogen (PTEXP-N2) cycle.

Referring to FIG. 10, is the heat and material balances of the pre-cooled twin expander methane (PTEXP-CH4) cycle.

The external or internal refrigerant working fluid compositions and temperatures are also dependent on the operating pressures. As described herein, treated gas pre-cooling and multiple stages, of compression will narrow the temperature gaps between the refrigerant working fluid and LNG, reducing loss work and increasing liquefaction efficiency.

In various embodiments described herein, LNG can be produced at a rate of 1.0 to 1.5 mmtpy or higher for one (1) LNG liquefaction train.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only and are not limiting. Accordingly, the scope of protection is not limited by the description set out above, but is only limited by the claims which follow, that scope including all equivalents of the subject matter of the claims.

The contemplated process of precooling of the natural gas feed to the liquefaction unit/train offers the following significant advantages:

a) Reduce the specific refrigerant power (kW/ton) by 10-15% for single mixed refrigerant process for mid-scale (1-1.5 mmtpy) LNG liquefaction facility.
b) Reduce the specific refrigerant power (kW/ton) by 10-15% for gas (N2/CH4) expander cycle process for mid-scale (1-1.5 mmtpy) LNG liquefaction facility.
c) Replace the refrigerant media (C3 or C2+C3 mixture) used for precooling the treated natural gas feed to the liquefaction unit, for the large baseload (>5 mmtpy) LNG facility, using APCI's C3MR/Shell's DMR/COP's OCP) process technology, with this precooling system, resulting in significant (30%) reduction in the (C3 or C2+C3) circulation rate and significant capital expenditure (CAPEX)/operating expenses (OPEX) savings.

The contemplated process described above can reduce the specific refrigerant (liquefaction) power (kW/ton), which is demonstrated by the liquefaction & refrigerant summary FIG. 4 and composite heat curves shown in FIG. 5, FIG. 6 and FIG. 7. Thermal efficiency have been significantly improved to be similar to dual mixed refrigerant (DMR) or lower than (C3MR) and 10-15% lower than other conventional single mixed refrigerant (SMR) processes and by 25-30% lower than other conventional gas (N2 or CH4—BOG) expander cycle process, which provides the lowest possible specific refrigerant (liquefaction) power (255-285 kW/ton).

Having described various devices and methods herein, exemplary embodiments or aspects can include, but are not limited to:

In a first embodiment, a system for pre-cooling a natural gas stream to a liquefaction plant may comprise a compressor configured to receive a first natural gas stream at a first pressure and produce a second natural gas stream at a second pressure; an exchanger, wherein the exchanger is configured to receive the second natural gas stream as the second pressure and cool the second natural gas stream to produce a cooled natural gas stream; and an expander, wherein the expander is configured to receive the cooled natural gas stream and expand the cooled natural gas stream from the second pressure to a third pressure.

A second embodiment can include the system of the first embodiment, wherein the exchanger is an ambient air exchanger configured to exchange heat between the second natural gas stream at the second pressure and an ambient air stream.

A third embodiment can include the system of the first or second embodiments, further comprising a second compressor configured to receive a natural gas feed stream at a fourth pressure and produce a fourth natural gas stream at the first pressure, wherein the first pressure is higher than the fourth pressure; and a second exchanger, wherein the second exchanger is configured to receive the fourth natural gas stream at the first pressure and cool the natural gas stream to produce the first natural gas stream.

A fourth embodiment can include the system of the third embodiment, wherein the natural gas stream at the third pressure is cooler than the natural gas stream at the fourth pressure.

A fifth embodiment can include the system of the third or fourth embodiments, wherein the third pressure is greater than the fourth pressure.

A sixth embodiment can include the system of any of the first to fifth embodiments, further comprising an LNG liquefaction system configured to receive the cooled natural gas stream at the third pressure.

A seventh embodiment can include the system of any of the first to sixth embodiments, wherein the compressing of the natural gas stream is performed by a compressor, wherein the expanding of the compressed natural gas stream is performed by an expander, and wherein the compressor and the expander are mechanically coupled.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically, and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as "comprises," "includes," and "having" should be understood to provide support for narrower terms such as "consisting of," "consisting essentially of," and "comprised substantially of" Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

In various embodiments described herein, LNG can be produced at a rate of 1.0 to 1.5 mmtpy.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A system for liquefying a natural gas stream for a liquefaction plant, the system comprising:

a heat exchanger configured to allow flow of a nitrogen refrigerant in a refrigerant stream through the heat exchanger;

wherein the refrigerant stream is split into a first split refrigerant stream in a first conduit and a second split refrigerant stream in a second conduit after flowing through the heat exchanger;

a first compressor-expander operable to expand the first split refrigerant stream and wherein the heat exchanger is configured to allow flow of the expanded first split refrigerant stream back through the heat exchanger;

wherein the heat exchanger is configured to allow flow of the second split refrigerant stream back through the heat exchanger;

a second compressor-expander operable to expand the second split refrigerant stream after flowing back through the heat exchanger and wherein the heat exchanger is configured to allow flow of the expanded second split refrigerant stream back through the heat exchanger;

wherein the second compressor-expander is operable to compress the expanded second split refrigerant stream after flowing back through the heat exchanger and wherein the first compressor-expander is operable to further compress the compressed second split refrigerant stream from the second compressor-expander; and wherein the system is configured to cool the natural gas to produce a liquefied natural gas (LNG) by flowing the natural gas through the heat exchanger.

2. The system of claim 1, wherein the expanded first split refrigerant stream, after flowing back through the heat exchanger, and the further compressed, compressed second split refrigerant stream are combined into a first common suction stream and compressed by a compressor before flowing back to the heat exchanger.

3. The system of claim 1, further comprising an expander operable to expand the LNG from the heat exchanger.

4. The system of claim 1, further comprising a pre-cooling system comprising a pre-cooling compressor operable to compress the natural gas before flowing to the heat exchanger.

5. The system of claim 4, further comprising a pre-cooling expander operable to expand the natural gas before flowing to the heat exchanger.

6. The system of claim 1, wherein the refrigerant stream is split at a ratio of 1:1 or lower for the first conduit as conduit as compared to the second conduit.

7. The system of claim 1, wherein the specific refrigerant power of the system is 269 kWh/ton of LNG.

8. A liquefied natural gas (LNG) liquefaction plant system for liquefying a natural gas stream, comprising:

a pre-cooling system comprising a pre-cooling compressor operable to compress the natural gas; and a heat exchanger system comprising:

a heat exchanger configured to allow flow of a nitrogen refrigerant in a refrigerant stream through the heat exchanger;

wherein the refrigerant stream is split into a first split refrigerant stream in a first conduit and a second split refrigerant stream in a second conduit after flowing through the heat exchanger;

a first compressor-expander operable to expand the first split refrigerant stream and wherein the heat exchanger is configured to allow flow of the expanded first split refrigerant stream back through the second heat exchanger;

wherein the heat exchanger is configured to allow flow of the second split refrigerant stream back through the heat exchanger;

a second compressor-expander operable to expand the second split refrigerant stream after flowing back through the heat exchanger and wherein the heat exchanger is configured to allow flow of the expanded second split refrigerant stream back through the heat exchanger;

wherein the second compressor-expander is operable to compress the expanded second split refrigerant stream after flowing back through the heat exchanger and wherein the first compressor-expander is operable to further compress the compressed second split refrigerant stream from the second compressor-expander; and wherein the system is configured to cool the natural gas to produce a liquefied natural gas (LNG) by flowing the natural gas through the heat exchanger.

9. The system of claim 8, further comprising:

a storage tank to receive the LNG from the heat exchanger;

an end flash gas (EFG) exchanger coupled to the storage tank with an LNG vapor conduit to direct LNG vapor (BOG) from the storage tank to the end flash gas (EFG) exchanger; and a compressor operable to compress the LNG vapor from the EFG exchanger and recycle the compressed LNG vapor back to the pre-cooling system.

10. The system of claim 8, wherein the expanded first split refrigerant stream, after flowing back through the heat exchanger, and the further compressed, compressed second split refrigerant stream are combined into a first common suction stream and compressed by a compressor before flowing back to the heat exchanger.

11. The system of claim 8, wherein the refrigerant stream is split at a ratio of 1:1 or lower for the first conduit as compared to the second conduit.

12. The system of claim 8, wherein the first and second split refrigerant streams are combined into a first common suction stream and compressed by a compressor before flowing back to the heat exchanger.

13. The system of claim 8, further comprising an expander operable to expand the LNG after flowing to the heat exchanger.

14. The system of claim 8, wherein the pre-cooling system further comprises a pre-cooling expander operable to expand the natural gas before flowing to the heat exchanger.

15. A method of LNG liquefaction, comprising:

flowing a produced natural gas stream through a heat exchanger;

flowing a nitrogen refrigerant in a refrigerant stream through the heat exchanger;

splitting the refrigerant stream into a first split refrigerant stream and a second split refrigerant stream after flowing through the heat exchanger;

expanding the first split refrigerant stream in a first compressor-expander and flowing the expanded first split refrigerant stream back through the heat exchanger;

flowing the second split refrigerant stream back through the heat exchanger;

expanding the second split refrigerant stream in a second compressor-expander after flowing back through the heat exchanger and flowing the expanded second split refrigerant stream back through the heat exchanger;

compressing, after flowing through the heat exchanger, the expanded second split refrigerant stream in the second compressor-expander and then in the first compressor-expander; and cooling the produced natural gas stream in the heat exchanger to produce a liquefied natural gas (LNG).

16. The method of claim 15, further comprising combining the expanded first split refrigerant stream from the heat exchanger and the compressed second split refrigerant stream from the first compressor-expander and compressing the combined first and second split refrigerant streams for flowing back to the heat exchanger.

17. The method of claim 15, further comprising expanding the LNG from the heat exchanger.

18. The method of claim 15, further comprising pre-cooling the natural gas stream before flowing to the heat exchanger.

19. The method of claim 18, wherein pre-cooling the natural gas stream comprises compressing, cooling, and then expanding the natural gas stream before flowing to the heat exchanger.

20. The method of claim 15, wherein splitting the refrigerant stream into the first split refrigerant stream and the second split refrigerant stream further comprises splitting the refrigerant stream at a ratio of 1:1 or lower for the first refrigerant stream as compared to the second refrigerant stream.

* * * * *